US010656573B2

(12) United States Patent
Aiba

(10) Patent No.: US 10,656,573 B2
(45) Date of Patent: May 19, 2020

(54) IMAGE HEATING APPARATUS AND IMAGE FORMING APPARATUS THAT CONTROL ELECTRICAL POWER SUPPLY TO A PLURALITY OF HEAT GENERATING ELEMENTS BASED ON A TEMPERATURE DETECTED BY A TEMPERATURE DETECTING ELEMENT

(71) Applicant: CANON KABUSHIKI KAISHA, Tokyo (JP)

(72) Inventor: Hirohiko Aiba, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/239,599

(22) Filed: Jan. 4, 2019

(65) Prior Publication Data

US 2019/0212679 A1 Jul. 11, 2019

(30) Foreign Application Priority Data

Jan. 5, 2018 (JP) ..... 2018-000873

(51) Int. Cl.
*G03G 15/20* (2006.01)
*G03G 15/00* (2006.01)

(52) U.S. Cl.
CPC ..... *G03G 15/2039* (2013.01); *G03G 15/2053* (2013.01); *G03G 15/2064* (2013.01); *G03G 15/5004* (2013.01); *H05B 2203/007* (2013.01)

(58) Field of Classification Search
CPC ..... G03G 15/2042
See application file for complete search history.

(56) References Cited

U.S. PATENT DOCUMENTS 8,909,084 B2 * 12/2014 Fujii ..... G03G 15/2042 399/330
9,176,440 B2 * 11/2015 Honda ..... G03G 15/2039
9,235,166 B2 1/2016 Shimura
(Continued)

FOREIGN PATENT DOCUMENTS

JP 2011-112866 A 6/2011
JP 2013-015576 A 1/2013
(Continued)

*Primary Examiner* — Clayton E. LaBalle
*Assistant Examiner* — Leon W Rhodes, Jr.
(74) *Attorney, Agent, or Firm* — Venable LLP

(57) ABSTRACT

An image heating apparatus includes a plurality of heat generating elements, a plurality of temperature detecting elements, and an energization controlling portion for selectively controlling, based on the temperature detected by each of the plurality of temperature detecting elements, electrical power to be supplied to the plurality of heat generating elements. The plurality of temperature detecting elements are arranged in each of the plurality of heat generating elements, and the energization controlling portion controls electrical power supply to the plurality of heat generating elements for the purpose of heating a non-sheet-passing heating region, through which a recording material does not pass, among the plurality of heating regions, based on a temperature detected by a temperature detecting element that is farthest from a conveyance reference position of the recording material, among the plurality of temperature detecting elements arranged in the non-sheet-passing heating region.

8 Claims, 19 Drawing Sheets

(56) References Cited

U.S. PATENT DOCUMENTS

| | | | | |
|---|---|---|---|---|
| 9,442,437 | B2 | 9/2016 | Honke et al. | |
| 2016/0070216 | A1 | 3/2016 | Shimura | |
| 2018/0027328 | A1 | 1/2018 | Kohara | |
| 2018/0253041 | A1 * | 9/2018 | Uchiyama ..... | H05B 3/20 |

FOREIGN PATENT DOCUMENTS

| | | | | |
|---|---|---|---|---|
| JP | 2014-059508 | A | | 4/2014 |
| JP | 2015-014645 | A | | 1/2015 |
| JP | 2015014645 | A | * | 1/2015 |
| JP | 2017-041743 | A | | 2/2017 |
| JP | 2018146957 | A | * | 9/2018 |

* cited by examiner

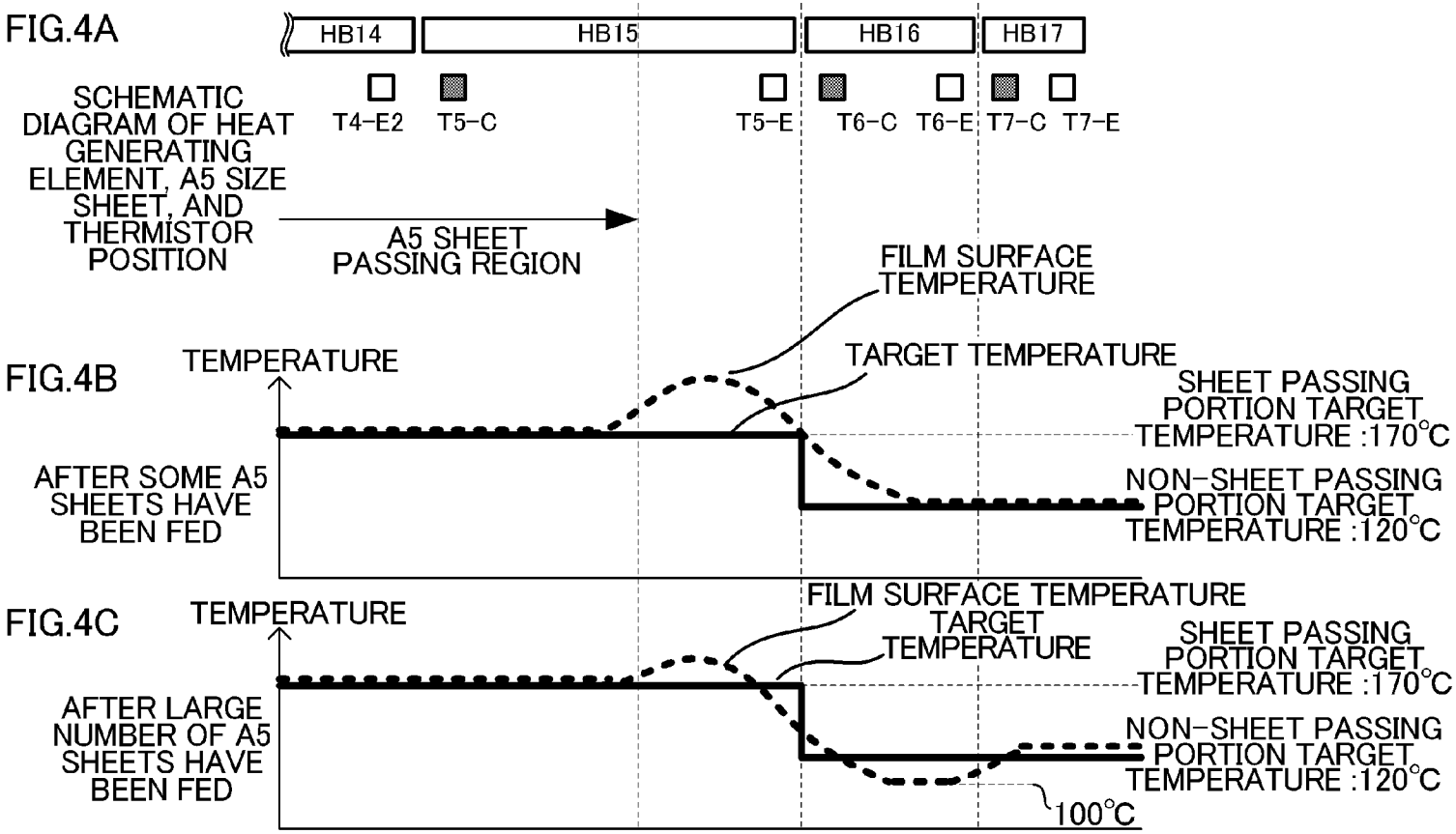
FIG.4A SCHEMATIC DIAGRAM OF HEAT GENERATING ELEMENT, A5 SIZE SHEET, AND THERMISTOR POSITION
FIG.4B AFTER SOME A5 SHEETS HAVE BEEN FED
FIG.4C AFTER LARGE NUMBER OF A5 SHEETS HAVE BEEN FED

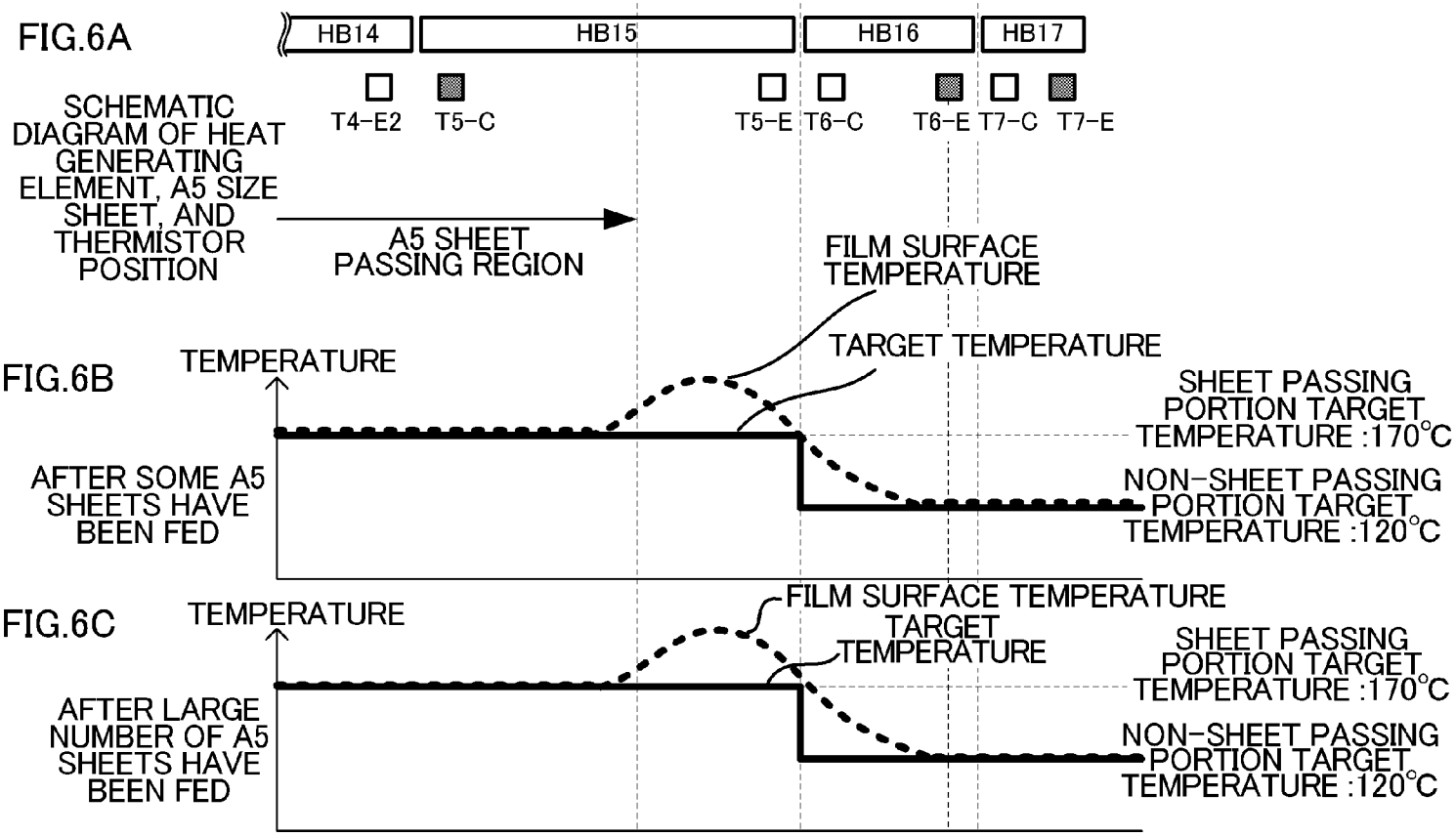
FIG.6A
SCHEMATIC DIAGRAM OF HEAT GENERATING ELEMENT, A5 SIZE SHEET, AND THERMISTOR POSITION
HB14
HB15
HB16
HB17
T4-E2
T5-C
T5-E
T6-C
T6-E
T7-C
T7-E
A5 SHEET PASSING REGION
FIG.6B
AFTER SOME A5 SHEETS HAVE BEEN FED
TEMPERATURE
FILM SURFACE TEMPERATURE
TARGET TEMPERATURE
SHEET PASSING PORTION TARGET TEMPERATURE :170°C
NON-SHEET PASSING PORTION TARGET TEMPERATURE :120°C
FIG.6C
AFTER LARGE NUMBER OF A5 SHEETS HAVE BEEN FED
TEMPERATURE
FILM SURFACE TEMPERATURE
TARGET TEMPERATURE
SHEET PASSING PORTION TARGET TEMPERATURE :170°C
NON-SHEET PASSING PORTION TARGET TEMPERATURE :120°C FIG.8A SCHEMATIC DIAGRAM OF HEAT GENERATING ELEMENT, A5 SIZE SHEET, AND THERMISTOR POSITION

FIG.8B AFTER SOME A5 SHEETS HAVE BEEN FED

FIG.8C TEMPERATURE DISTRIBUTION AFTER THROUGHPUT DOWN CONTROL

FIG.10A SCHEMATIC DIAGRAM OF HEAT GENERATING ELEMENT, A5 SIZE SHEET, AND THERMISTOR POSITION

FIG.10B AFTER SOME A5 SHEETS HAVE BEEN FED

FIG.10C TEMPERATURE DISTRIBUTION AFTER CHANGE OF HB16 TARGET TEMPERATURE

FIG.12A SCHEMATIC DIAGRAM OF HEAT GENERATING ELEMENT, A5 SIZE SHEET, AND THERMISTOR POSITION

FIG.12B AFTER SOME A5 SHEETS HAVE BEEN FED

FIG.12C TEMPERATURE DISTRIBUTION AFTER CHANGE OF HB17 TARGET TEMPERATURE

FIG.14A SCHEMATIC DIAGRAM OF HEAT GENERATING ELEMENT, SHEET, IMAGE, AND THERMISTOR POSITION

FIG.14B AFTER SOME SHEETS HAVE BEEN FED

FIG.14C AFTER LARGE NUMBER OF SHEETS HAVE BEEN FED

FIG.16A SCHEMATIC DIAGRAM OF HEAT GENERATING ELEMENT, SHEET, IMAGE, AND THERMISTOR POSITION

FIG.16B AFTER SOME SHEETS HAVE BEEN FED

FIG.16C AFTER LARGE NUMBER OF SHEETS HAVE BEEN FED

FIG.18A SCHEMATIC DIAGRAM OF HEAT GENERATING BLOCK, SHEET, IMAGE, AND THERMISTOR POSITION

FIG.18B TEMPERATURE DISTRIBUTION

IMAGE HEATING APPARATUS AND IMAGE FORMING APPARATUS THAT CONTROL ELECTRICAL POWER SUPPLY TO A PLURALITY OF HEAT GENERATING ELEMENTS BASED ON A TEMPERATURE DETECTED BY A TEMPERATURE DETECTING ELEMENT

This application claims the benefit of Japanese Patent Application No. 2018-000873, filed on Jan. 5, 2018, which is hereby incorporated by reference herein in its entirety.

BACKGROUND OF THE INVENTION

Field of the Invention

The present invention relates to an image heating apparatus, such as a fixing unit, that is mounted on an image forming apparatus utilizing an electrophotographic system or an electrostatic recording system, such as a copying machine or a printer, or a gloss-imparting device for reheating a toner image fixed on a recording material, thereby increasing the gloss level of the toner image. The present invention also relates to an image forming apparatus including the image heating apparatus.

Description of the Related Art

As an image heating apparatus, there is an apparatus including a tubular film, a heater in contact with the inner surface of the film, and a roller forming a nip portion together with the heater through the film. When an image forming apparatus, in which the image heating apparatus is mounted, performs printing successively with small-sized sheets, there occurs a phenomenon in which the temperature of a region (non-sheet passing portion) through which the sheets do not pass, in the longitudinal direction of the nip portion, gradually increases (non-sheet passing portion temperature rise). In the image heating apparatus, it is necessary to prevent the non-sheet passing portion from reaching a temperature exceeding the heat-resistant temperature of each member in the apparatus. As an approach to preventing the non-sheet passing portion temperature rise, there is proposed an apparatus in which a heat generating resistor on a heater is divided in the longitudinal direction of the heater into a plurality of groups (heat generating blocks), and heat generation distribution (heating region) is changed on the basis of the size of recording materials (Japanese Patent Application Laid-open No. 2014-59508). In the above-mentioned apparatus, the temperature of a sheet passing portion through which a recording material passes is controlled to a temperature necessary for fixing a toner image, and the temperature of a non-sheet passing portion is controlled to a lower-limit temperature necessary for a film to rotate by lowering a control temperature or interrupting heat generation, in order to save energy, among other benefits. The plurality of heat generating blocks, which are obtained through division, each include a detection member for detecting the temperature of a heat generating element, and the amount of heat generation is controlled on the basis of the result of detection. With regard to a heat generating block corresponding to the end position of a recording material, one heat generating block has the sheet passing portion and the non-sheet passing portion, and thus, the one heat generating block has a temperature difference in the longitudinal direction. In view of this, there is also proposed an apparatus in which a plurality of temperature detecting units different in longitudinal position are arranged for each heat generating block, and the temperature of each portion is detected to be used for control (Japanese Patent Application No. 2017-41743). There is also proposed a method for controlling, in this case, the heat generating block on the basis of a temperature detected by a temperature detecting unit, which is close to a conveyance reference position of a recording material in the longitudinal direction, among the plurality of temperature detecting units.

SUMMARY OF THE INVENTION

When a heat generating block, of the heat generating blocks, which are obtained through division, corresponding to the non-sheet passing portion is controlled with the detection member, which is close to the conveyance reference position, among the plurality of temperature detecting units, however, the temperature of a portion far from the conveyance reference position falls below the lower-limit temperature necessary for the film to rotate in some cases. The temperature detecting unit close to the conveyance reference position detects a temperature greater than the control temperature due to the effect of the temperature of the sheet passing region, which has a high temperature, or the non-sheet passing portion temperature rise. Thus, when the heat generating block is controlled with the temperature detecting unit close to the conveyance reference position, electrical power is reduced so that the temperature converges to the control temperature, and the temperature of the portion that is far from the conveyance reference position, and that is thus not affected by the non-sheet passing portion temperature rise, falls below the control temperature. The control temperature for the heat generating block corresponding to the non-sheet passing portion is set to the lower-limit temperature necessary for the film to rotate, and hence, the viscosity of grease for helping the film rotation, increases to increase the torque in the portion having a temperature falling below the control temperature, which hinders the film rotation. As a result, the occurrence of a conveyance failure of recording materials is possible.

SUMMARY OF THE INVENTION

It is an object of the present invention to provide a technology for appropriately controlling the temperature of each of entire longitudinal regions of a plurality of heat generating blocks, thereby enabling stable conveyance of recording materials.

In order to achieve the above-mentioned object, according to one aspect, the present invention provides an image heating apparatus including an image heating portion that includes a heater including a substrate and a plurality of heat generating elements provided on the substrate and aligned in a longitudinal direction of the substrate, and heats an image formed on a recording material using heat of the heater, a plurality of temperature detecting elements for detecting temperatures of the plurality of heat generating elements, and an energization controlling portion for selectively controlling, based on the temperature detected by each of the plurality of temperature detecting elements, electrical power to be supplied to the plurality of heat generating elements, in order to selectively heat a plurality of heating regions that are heated by the plurality of heat generating elements, wherein the plurality of temperature detecting elements are arranged in each of the plurality of heat generating elements, and wherein the energization controlling portion controls electrical power supply to the plurality of heat generating elements for the purpose of heating a non-sheet-passing heating region, through which the recording material does not pass, among the plurality of heating regions, based on a temperature detected by a temperature detecting element, which is farthest from a conveyance reference position of the recording material, among the plurality of temperature detecting elements arranged in the non-sheet-passing heating region.

In order to achieve the above-mentioned object, according to another aspect, the present invention provides an image heating apparatus including an image heating portion that includes a heater including a substrate and a plurality of heat generating elements provided on the substrate and aligned in a longitudinal direction of the substrate, and heats an image formed on a recording material using heat of the heater, a plurality of temperature detecting elements for detecting temperatures of the plurality of heat generating elements, and an energization controlling portion for selectively controlling, based on the temperature detected by each of the plurality of temperature detecting elements, electrical power to be supplied to the plurality of heat generating elements, in order to selectively heat a plurality of heating regions that are heated by the plurality of heat generating elements, wherein the plurality of temperature detecting elements are arranged in each of the plurality of heat generating elements, and wherein, when images formed on a plurality of recording materials are successively heated, the energization controlling portion controls a conveyance interval of the recording materials based on a temperature detected by a temperature detecting element, which is farthest from a conveyance reference position of the recording materials, among the plurality of temperature detecting elements arranged in a non-sheet-passing heating region, through which the recording materials do not pass, among the plurality of heating regions.

In order to achieve the above-mentioned object, according to still another aspect, the present invention provides an image heating apparatus including an image heating portion that includes a heater including a substrate and a plurality of heat generating elements provided on the substrate and aligned in a longitudinal direction of the substrate, and heats an image formed on a recording material using heat of the heater, a plurality of temperature detecting elements for detecting temperatures of the plurality of heat generating elements, and an energization controlling portion for selectively controlling, based on the temperature detected by each of the plurality of temperature detecting elements, electrical power to be supplied to the plurality of heat generating elements, in order to selectively heat a plurality of heating regions that are heated by the plurality of heat generating elements, wherein the plurality of temperature detecting elements are arranged in each of the plurality of heat generating elements, and wherein the energization controlling portion controls electrical power supply to the plurality of heat generating elements for the purpose of heating an adjacent heating region, which is adjacent to a sheet-passing heating region through which the recording material passes, among non-sheet-passing heating regions, through which the recording material does not pass, among the plurality of heating regions, based on a temperature detected by a temperature detecting element, which is farthest from a conveyance reference position of the recording material, among the plurality of temperature detecting elements arranged in the adjacent heating region, with a target temperature being a temperature that is greater than a target temperature for heating a non-adjacent heating region, which is not adjacent to the sheet-passing heating region, among the non-sheet-passing heating regions, and is less than a target temperature for heating the sheet-passing heating region.

In order to achieve the above-mentioned object, according to yet another aspect, the present invention provides an image heating apparatus including an image heating portion that includes a heater including a substrate and a plurality of heat generating elements provided on the substrate and aligned in a longitudinal direction of the substrate, and heats an image formed on a recording material using heat of the heater, a plurality of temperature detecting elements for detecting temperatures of the plurality of heat generating elements, and an energization controlling portion for selectively controlling, based on the temperature detected by each of the plurality of temperature detecting elements, electrical power to be supplied to the plurality of heat generating elements, in order to selectively heat a plurality of heating regions that are heated by the plurality of heat generating elements, wherein the plurality of temperature detecting elements are arranged in each of the plurality of heat generating elements, and wherein the energization controlling portion controls electrical power supply to the plurality of heat generating elements for the purpose of heating a non-adjacent heating region, which is not adjacent to a sheet-passing heating region through which the recording material passes, among non-sheet-passing heating regions, through which the recording material does not pass, among the plurality of heating regions, based on a temperature detected by a temperature detecting element, which is farthest from a conveyance reference position of the recording material, among the plurality of temperature detecting elements arranged in an adjacent heating region, which is adjacent to the sheet-passing heating region, among the non-sheet-passing heating regions, with a target temperature being a temperature that is greater than a target temperature for heating the adjacent heating region and is less than a target temperature for heating the sheet-passing heating region.

In order to achieve the above-mentioned object, according to yet another aspect, the present invention provides an image heating apparatus including an image heating portion that includes a heater including a substrate and a plurality of heat generating elements provided on the substrate and aligned in a longitudinal direction of the substrate, and heats an image formed on a recording material using heat of the heater, a plurality of temperature detecting elements for detecting temperatures of the plurality of heat generating elements, and an energization controlling portion for selectively controlling, based on the temperature detected by each of the plurality of temperature detecting elements, electrical power to be supplied to the plurality of heat generating elements, in order to selectively heat a plurality of heating regions that are heated by the plurality of heat generating elements, wherein the plurality of temperature detecting elements are arranged in each of the plurality of heat generating elements, and wherein the energization controlling portion controls electrical power supply to the plurality of heat generating elements for the purpose of heating a non-image heating region, through which the image formed on the recording material does not pass, among the plurality of heating regions, based on a temperature detected by a temperature detecting element, which is farthest from a conveyance reference position of the recording material, among the plurality of temperature detecting elements arranged in the non-image heating region.

In order to achieve the above-mentioned object, according to yet another aspect, the present invention provides an image heating apparatus including an image heating portion that includes a heater including a substrate and a plurality of heat generating elements provided on the substrate and aligned in a longitudinal direction of the substrate, and heats an image formed on a recording material using heat of the heater, a plurality of temperature detecting elements for detecting temperatures of the plurality of heat generating elements, and an energization controlling portion for selectively controlling, based on the temperature detected by each of the plurality of temperature detecting elements, electrical power to be supplied to the plurality of heat generating elements, in order to selectively heat a plurality of heating regions that are heated by the plurality of heat generating elements, wherein the plurality of temperature detecting elements are arranged in each of the plurality of heat generating elements, and wherein when images formed on a plurality of recording materials are successively heated, the energization controlling portion controls a conveyance interval of the recording materials based on a temperature detected by a temperature detecting element, which is farthest from a conveyance reference position of the recording materials, among the plurality of temperature detecting elements arranged in a non-image heating region, through which the images formed on the recording materials do not pass, among the plurality of heating regions.

In order to achieve the above-mentioned object, according to yet another aspect, the present invention provides an image heating apparatus including an image heating portion that includes a heater including a substrate and a plurality of heat generating elements provided on the substrate and aligned in a longitudinal direction of the substrate, and heats an image formed on a recording material using heat of the heater, a plurality of temperature detecting elements for detecting temperatures of the plurality of heat generating elements, and an energization controlling portion for selectively controlling, based on the temperature detected by each of the plurality of temperature detecting elements, electrical power to be supplied to the plurality of heat generating elements, in order to selectively heat a plurality of heating regions that are heated by the plurality of heat generating elements, wherein the plurality of temperature detecting elements are arranged in each of the plurality of heat generating elements, and wherein the energization controlling portion controls electrical power supply to the plurality of heat generating elements for the purpose of heating a non-image heating region, through which the image formed on the recording material does not pass, among the plurality of heating regions, as follows: (i) when heating regions adjacent to the non-image heating region are both image heating regions through which the image formed on the recording material passes, the energization controlling portion performs the control based on a temperature detected by a temperature detecting element, among the plurality of temperature detecting elements arranged in the non-image heating region, the temperature detecting element being closest to an image heating region through which a greater amount of toner passes, among the image heating regions adjacent to the non-image heating region, and (ii) when one or none of the heating regions adjacent to the non-image heating region is the image heating region, the energization controlling portion performs the control based on a temperature detected by a temperature detecting element, which is farthest from the image, among the plurality of temperature detecting elements arranged in the non-image heating region.

In order to achieve the above-mentioned object, according to yet another aspect, the present invention provides an image forming apparatus including an image forming portion for forming an image on a recording material, and a fixing portion for fixing, to the recording material, the image formed on the recording material, wherein the fixing portion is the image heating apparatus.

According to the present inventions, it is possible to appropriately control the temperature of each of the entire longitudinal regions of the plurality of heat generating blocks, thereby enabling stable conveyance of recording materials.

Further features of the present inventions will become apparent from the following description of exemplary embodiments with reference to the attached drawings.

BRIEF DESCRIPTION OF THE DRAWINGS

FIG. 4A to FIG. 4C illustrate temperature distribution of comparative example of Embodiment 1.

FIG. 6A to FIG. 6C illustrate temperature distribution of Embodiment 1.

DESCRIPTION OF THE EMBODIMENTS

Hereafter, a description will be given, with reference to the drawings, of embodiments of the present inventions. The sizes, materials, shapes, their relative arrangements, or the like, of constituents described in the embodiments may, however, be appropriately changed according to the configurations, various conditions, or the like, of apparatuses to which the invention is applied. Therefore, the sizes, materials, shapes, their relative arrangements, or the like, of the constituents described in the embodiments do not intend to limit the scope of the invention to the following embodiments.

Embodiment 1

Figure 1:
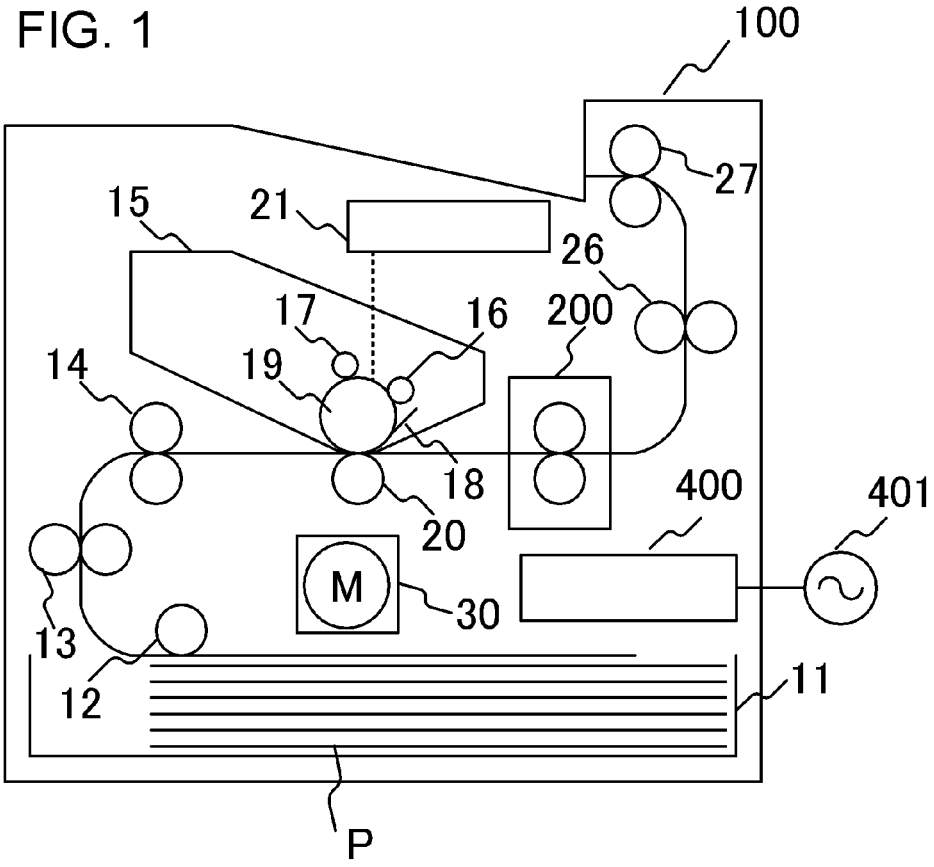
FIG. 1 is a sectional view of an image forming apparatus according to an embodiment of the present invention.

FIG. 1 is a schematic sectional view of an image forming apparatus according to an embodiment of the present invention. An image forming apparatus 100 of the present embodiment is a laser printer for forming an image on a recording material utilizing an electrophotographic system. When a print signal is generated, a scanner unit 21 emits laser light modulated on the basis of image information, thereby scanning a photosensitive member 19 charged to a predetermined polarity by a charging roller 16. With this, an electrostatic latent image is formed on the photosensitive member 19. A developing device 17 supplies toner to the electrostatic latent image, and a toner image based on the image information is thus formed on the photosensitive member 19. Meanwhile, recording materials (recording sheets) P stacked in a sheet-feeding cassette 11 are fed one by one by a pickup roller 12 to be conveyed by a roller 13 toward a registration roller 14. The recording material P further conveyed from the registration roller 14 to a transfer position formed by the photosensitive member 19 and the transfer roller 20 in synchronization with a timing at which the toner image on the photosensitive member 19 arrives at the transfer position. When the recording material P passes through the transfer position, the toner image on the photosensitive member 19 is transferred onto the recording material P. After that, the recording material P is heated by a fixing apparatus (image heating apparatus) 200, which serves as a fixing portion (image heating portion), and the toner image is heat fixed to the recording material P. The recording material P bearing the fixed toner image is discharged to a tray by rollers 26 and 27. The tray is located in the upper portion of the laser printer 100. A cleaner 18 cleans the photosensitive member 19. The fixing apparatus 200 is supplied with electrical power from a control circuit 400, which serves as control means (energization controlling portion) connected to a commercial alternating current power supply 401. The photosensitive member 19, the charging roller 16, the scanner unit 21, the developing device 17, and the transfer roller 20 described above construct an image forming portion for forming an image that is not fixed to the recording material P. A cartridge 15 is a replaceable unit.

The laser printer 100 of the present embodiment supports a plurality of recording material sizes. In the sheet-feeding cassette 11, letter size sheets (about 216 mm×279 mm), A4 sheets (210 mm×297 mm), executive size sheets (about 184 mm×267 mm), and A5 sheets (148 mm×210 mm) can be set, for example.

Basically, the printer 100 of the present embodiment is a laser printer for feeding sheets by short edge feeding (conveying a sheet with the long side of the sheet being in parallel with the conveyance direction). The configuration according to the present embodiment can also be applied to a printer for feeding sheets by long edge feeding. Further, a recording material having the largest size (largest width), out of recording materials having standard widths (recording material widths on the brochure) supported by the apparatus, is a letter size sheet having a width of about 216 mm. Further, the above-mentioned image forming apparatus is described by taking a monochrome laser printer using monochrome toner with a single color as a representative example, but the present invention is not limited thereto. The present invention can also be applied to, for example, a tandem type color printer for transferring toners of two or more colors onto a recording material through an intermediate transfer belt, thereby forming an image.

Figure 2:
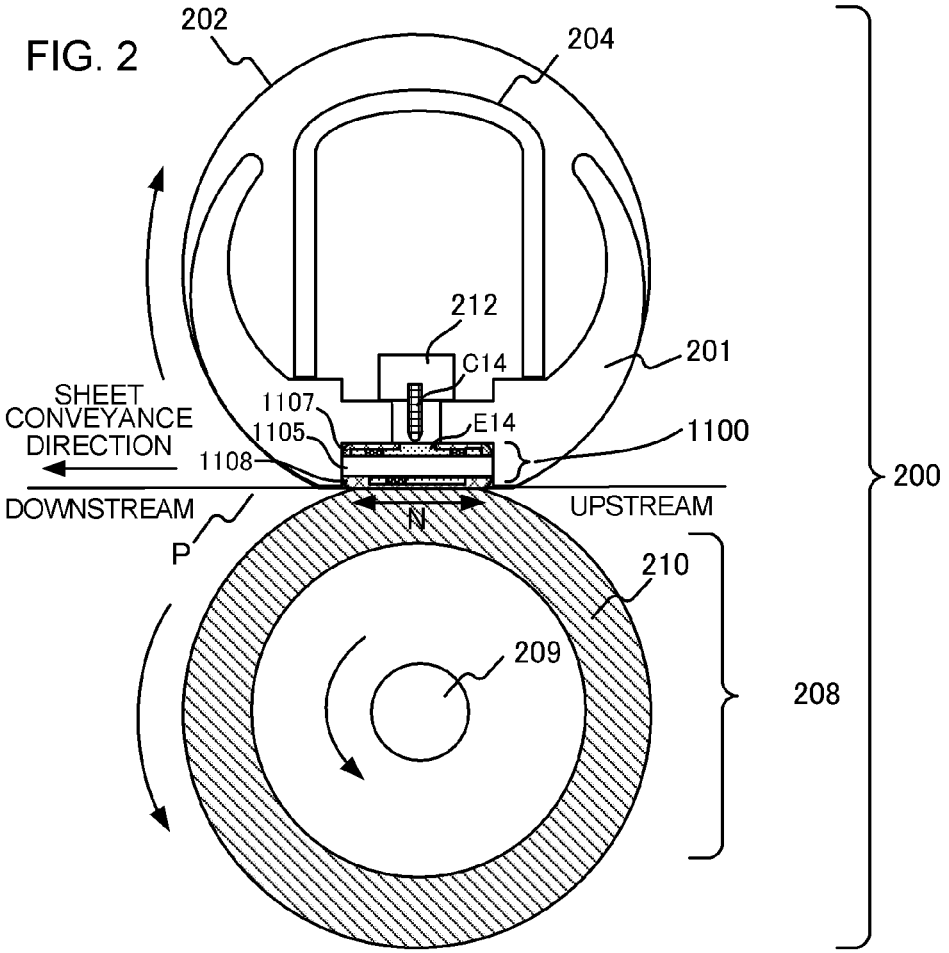
FIG. 2 is a sectional view of a fixing apparatus of Embodiment 1.

FIG. 2 is a schematic sectional view of the fixing apparatus 200 that serves as the image heating apparatus, according to the present embodiment. The fixing apparatus 200 includes a tubular film 202 that is a heating rotating member, a heater 1100 in contact with the inner surface of the film 202, and a pressure roller (pressure rotating member) 208 forming a fixing nip portion N together with the heater 1100 through the film 202. The base layer of the film 202 is made of a material that is a heat-resistant resin, such as polyimide, or a metal, such as stainless steel. Further, the film 202 may be provided with an elastic layer made of a material, such as heat-resistant rubber, or a mold release layer made of a heat-resistant resin. The pressure roller 208 includes a metal core 209 made of a material, such as iron or aluminum, and an elastic layer 210 made of a material, such as silicone rubber. The heater 1100 is held by a holding member 201 made of a heat-resistant resin, such as liquid crystal polymer. The holding member 201 also has a guide function for guiding the rotation of the film 202.

To sliding portions between the film 202, and the heater 1100 and the holding member 201, viscous grease, which is not shown, is applied. This grease is a mixture of a fluorine resin and a fluorine oil, and has a role of lowering sliding resistance between the film 202, and the heater 1100 and the holding member 201. The viscosity of the grease is correlated with temperature. As temperature becomes higher, the viscosity becomes lower to improve the slidability.

The pressure roller 208 rotates in a direction indicated by the arrow when receiving power from a motor 30, which serves as a power source. When the pressure roller 208 rotates, the film 202 follows the rotation to rotate. The recording material P bearing an unfixed toner image is subjected to fixing treatment at the fixing nip portion N by being heated while being nipped and conveyed. As described above, the fixing apparatus 200 includes the tubular film 202 and the heater 1100 in contact with the inner surface of the film 202, and heats an image formed on a recording material with the heat from the heater 1100 through the film 202.

The heater 1100 includes a substrate 1105 made of ceramic and a heat generating resistor (heat generating element) (see FIG. 3A to FIG. 3C) that is provided on the substrate 1105 and generates heat when being supplied with electrical power. On a surface (first surface) of the substrate 1105 that forms the fixing nip portion N, a surface protective layer 1108 made of glass is provided to ensure the slidability of the film 202. On a surface (second surface) of the substrate 1105 that is opposite to the surface on the fixing nip portion N side, a surface protective layer 1107 made of glass is provided to insulate the heat generating resistor. On the second surface, an electrode (in FIG. 2, E14 is illustrated as a representative) is exposed, and an electrical contact for power supply (in FIG. 2, C14 is illustrated as a representative) is brought into contact with the electrode so that the heat generating resistor is electrically connected to the alternating current power supply 401. The details of the heater 1100 are described later.

A protective element 212 is, for example, a thermal switch or a thermal fuse configured to operate to cut off the supply of electrical power to the heater 1100 when there is abnormal heat generation of the heater 1100. The protective element 212 is placed in abutment against the heater 1100 or is placed with a slight gap between the heater 1100 and the protective element 212. A metal stay 204 applies the pressure of a spring, which is not shown, to the holding member 201. The stay 204 also has a role of reinforcing the holding member 201 and the heater 1100.

Figure 3A:
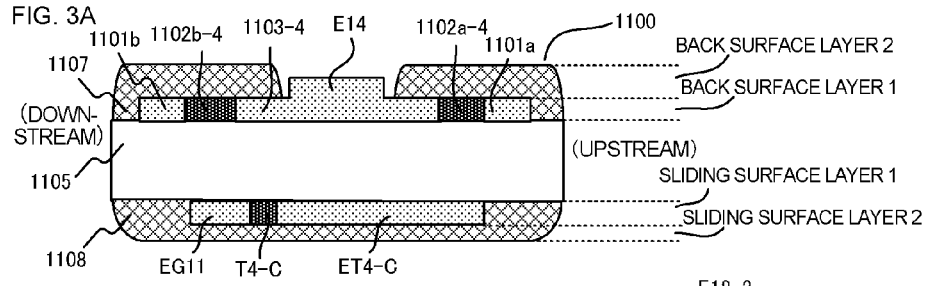
FIG. 3A to FIG. 3C are views of the configuration of a heater of Embodiment 1.
Figure 3B:
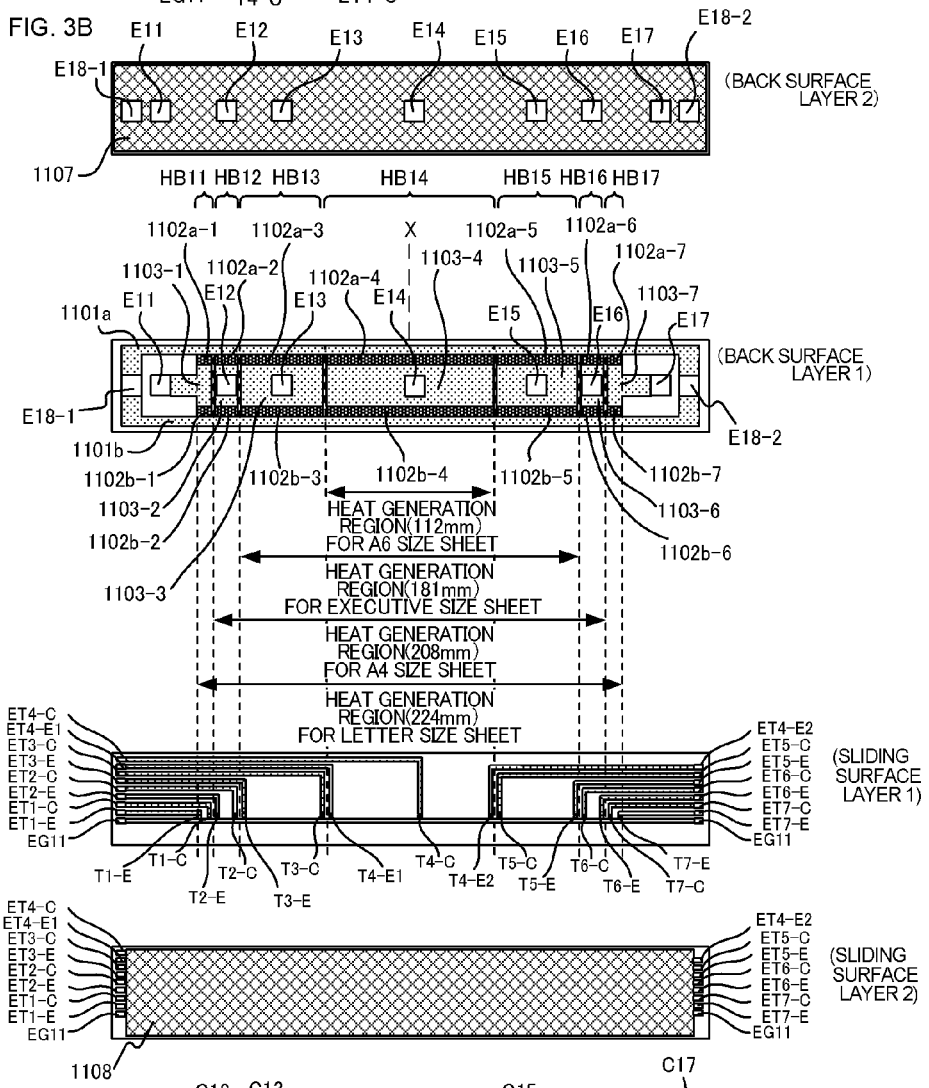
Figure 3C:
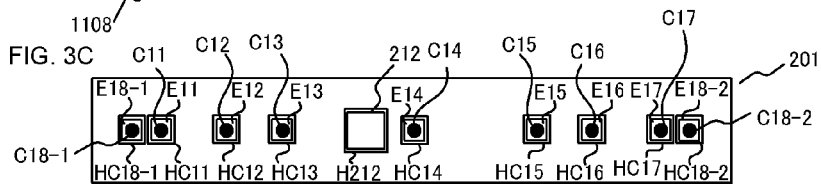

FIG. 3A and FIG. 3B are views illustrating the configuration of the heater 1100 of Embodiment 1. FIG. 3A is a sectional view illustrating a portion of the heater 1100 in the vicinity of a conveyance reference position X of the recording material P, which is illustrated in FIG. 3B. FIG. 3B is a plan view illustrating each layer of the heater 1100. FIG. 3C is a plan view of the holding member configured to hold the heater 1100.

The printer of the present embodiment is a center-reference printer configured to convey a recording material with the center of the recording material in the width direction (a direction orthogonal to the conveyance direction) being matched with the conveyance reference position X.

Next, the configuration of the heater 1100 is described in detail. The heater 1100 includes a back-surface layer 1 that is a heater surface opposite to a heater surface in contact with the film 202. On the back-surface layer 1, a plurality of heat generating blocks, each of which is a combination of a first conductor 1101, a second conductor 1103, and a heat generating resistor (heat generating element) 1102, are provided in the longitudinal direction of the heater 1100. The heater 1100 of the present embodiment has a total of seven heat generating blocks HB11 to HB17, and forms various heat generation ranges based on the size of recording materials by selectively combining the seven heating regions, which are obtained through division in the longitudinal direction. Individual control for the heat generating blocks is described later.

The heat generating blocks each include the first conductor 1101 provided along the longitudinal direction of the substrate, and the second conductor 1103 provided along the longitudinal direction of the substrate. The first conductor 1101 and the second conductor 1103 are provided at positions different in the lateral direction (a direction orthogonal to the longitudinal direction) of the substrate. The heat generating block further includes the heat generating resistor 1102 that is provided between the first conductor 1101 and the second conductor 1103 and generates heat when being supplied with electrical power through the first conductor 1101 and the second conductor 1103.

The heat generating resistor 1102 of each heat generating block is divided into a heat generating resistor 1102*a* and a heat generating resistor 1102*b* that are formed at positions symmetric to each other with respect to a substrate center in the lateral direction of the heater 1100. Further, the first conductor 1101 is divided into a conductor 1101*a* connected to the heat generating resistor 1102*a*, and a conductor 1101*b* connected to the heat generating resistor 1102*b*. The heat generating resistor 1102*a* and the heat generating resistor 1102*b* are formed at the positions symmetric to each other with respect to the substrate center.

The heater 1100 has the seven heat generating blocks HB11 to HB17, and hence, the heat generating resistor 1102*a* is divided into seven heat generating resistors 1102*a*-1 to 1102*a*-7. In a similar manner, the heat generating resistor 1102*b* is divided into seven heat generating resistors 1102*b*-1 to 1102*b*-7. In addition, the second conductor 1103 is divided into seven second conductors 1103-1 to 1103-7. The heat generating resistors 1102*a*-1 to 1102*a*-7 are arranged in the substrate 1105 upstream of the conveyance direction of the recording material P, and the heat generating resistors 1102*b*-1 to 1102*b*-7 are arranged in the substrate 1105 downstream of the conveyance direction of the recording material P.

On a back-surface layer 2 of the heater 1100, the insulting surface protective layer 1107 (glass in the present embodiment) for covering the heat generating resistor 1102, the first conductor 1101, and the second conductor 1103 is provided. The surface protective layer 1107 does not, however, cover electrode portions E11 to E17, E18-1, and E18-2 with which electrical contacts for power supply C11 to C17, C18-1, and C18-2 are in contact. The electrodes E11 to E17 are electrodes configured to supply electrical power to the heat generating blocks HB11 to HB17 through the respective second conductors 1103-1 to 1103-7. The electrodes E18-1 and E18-2 are electrodes configured to supply electrical power to the heat generating blocks HB11 to HB17 through the first conductors 1101*a* and 1101*b*.

Incidentally, the conductors have resistance values which are not zero, and thus affect heat generation distribution in the longitudinal direction of the heater 1100. In view of this, the electrodes E18-1 and E18-2 are provided at the end portions of the heater 1100 in the longitudinal direction so that uniform heat generation distribution is maintained even with the effect of electrical resistance of the first conductors 1101*a* and 1101*b* and the second conductors 1103-1 to 1103-7.

As illustrated in FIG. 2, in a space between the stay 204 and the holding member 201, the protective element 212 and the electrical contacts C11 to C17, C18-1, and C18-2 are provided. As illustrated in FIG. 3C, in the holding member 201, holes HC11 to HC17, HC18-1, and HC18-2 are formed. Through the holes HC11 to HC17, HC18-1, and HC18-2, the electrical contacts C11 to C17, C18-1, and C18-2, which are connected to the electrodes E11 to E17, E18-1, and E18-2, pass. Further, in the holding member 201, a hole H212, through which the heat sensitive portion of the protective element 212 passes, is also formed. The electrical contacts C11 to C17, C18-1, and C18-2 are electrically connected to the corresponding electrodes by means of biasing by a spring or welding, for example. The protective element 212 is also biased by a spring so that the heat sensitive portion of the protective element 212 is in contact with the surface protective layer 1107. Each electrical contact is connected to the control circuit of the heater 1100 through a cable or a conductive member such as a thin metal plate provided in the space between the stay 204 and the holding member 201.

The electrodes are provided on the back surface of the heater 1100. It is thus not necessary to secure, on the substrate 1105, a region for wires to be electrically connected to the respective second conductors 1103-1 to 1103-7, and hence, the width of the substrate 1105 in the lateral direction can be shortened. Consequently, an increase in size of the heater can be prevented. As illustrated in FIG. 3B, the electrodes E12 to E16 are provided in the region in which the heat generating resistors are provided in the longitudinal direction of the substrate.

As described later, the heater 1100 of the present example independently controls the plurality of heat generating blocks, thereby being capable of forming various heat generation distribution patterns (heating regions). For example, the heater 1100 can set heat generation distribution based on the size of recording materials. In addition, the heat generating resistor 1102 is made of a material having a positive temperature coefficient (PTC). When the material having a PTC is used, temperature rise in a non-sheet passing portion can be prevented even in a case in which the end portion of a recording material and the boundary between the heat generating blocks are not matched with each other.

On a sliding-surface layer 1 on the sliding surface side of the heater 1100, a plurality of thermistors T1-C to T7-C, T1-E to T3-E, T4-E1, T4-E2, and T5-E to T7-E for detecting temperatures of the heat generating blocks HB11 to HB17 are formed. The sliding surface is a surface of the heater 1100 that is in contact with the film 202. The thermistor (temperature detecting element) may be made of a material having a large positive or negative temperature coefficient of resistance (TCR). In the present example, a material having a negative temperature coefficient (NTC) is thinly printed on the substrate to form the thermistor, which serves as temperature detecting means. With the use of the thermistors, the film is controlled to have a target temperature.

An arrangement of the thermistors for each heat generating block is described.

As illustrated in FIG. 3B, a plurality of thermistors are arranged for one heat generating block. For example, the two thermistors T5-C and T5-E are arranged for the heat generating block HB15, and can detect temperature with conductive patterns for resistance value detection ET5-C and ET5-E, and a common conductive pattern EG11.

In the configuration of the present embodiment, the thermistor T5-C is placed in an end portion region adjacent to the heat generating block HB14, and the thermistor T5-E is placed in an end portion region adjacent to the heat generating block HB16. Depending on sheet sizes, the edge of a sheet passes through the heat generating block HB15 in some cases. The thermistor T5-C is placed in the end portion close to the sheet passing reference so that the thermistor T5-C is mostly included in the sheet passing region regardless of a change in sheet width. The thermistor T5-E is, on the other hand, placed in the end portion far from the sheet passing reference so that the thermistor T5-E is mostly included in the non-sheet passing region.

In a similar manner, for the heat generating blocks HB11 to HB17, the thermistors T1-C to T7-C close to the sheet passing reference, and the thermistors T1-E to T3-E, T4-E1, T4-E2, and T5-E to T7-E are arranged far from the sheet passing reference.

The longitudinal positions of the thermistors are not limited to the ones in the present embodiment. For example, the thermistors T1-C to T7-C may be arranged at the longitudinal centers of the respective heat generating blocks.

On a surface (sliding-surface layer 2) on the fixing nip portion N side of the substrate 1105, in order to ensure the slidability of the film 202, the insulating surface protective layer 1108 (made of glass in the present embodiment) is formed through coating. The surface protective layer 1108 covers the thermistors, the conductive patterns, and the common conductive pattern. The surface protective layer 1108, however, partly exposes the conductive patterns and the common conductive pattern at the end portions of the heater 1100, as illustrated in FIG. 3B, to thereby establish connection with the electrical contacts.

Of the heat generating blocks, which are obtained through division, a heat generating block through which a recording material passes is set to the target temperature of a "sheet passing portion", and is controlled so that the film temperature reaches a target temperature necessary for fixing a toner image on the recording material. Meanwhile, a heat generating block through which the recording material does not pass is set to the target temperature of the "non-sheet passing portion", and is set to a temperature as low as possible (a heat generating element corresponding to the heat generating block is supplied with the small amount of electrical power) in the light of energy saving.

TABLE 1

| Recording Material Width W | HB11 | HB12 | HB13 | HB14 | HB15 | HB16 | HB17 |
|---|---|---|---|---|---|---|---|
| 210 mm < W | Sheet Passing Portion | Sheet Passing Portion | Sheet Passing Portion | Sheet Passing Portion | Sheet Passing Portion | Sheet Passing Portion | Sheet Passing Portion |
| 185 mm < W ≤ 210 mm | Non-sheet Passing Portion | Sheet Passing Portion | Sheet Passing Portion | Sheet Passing Portion | Sheet Passing Portion | Sheet Passing Portion | Non-sheet Passing Portion |
| 105 mm < W ≤ 185 mm | Non-sheet Passing Portion | Non-sheet Passing Portion | Sheet Passing Portion | Sheet Passing Portion | Sheet Passing Portion | Non-sheet Passing Portion | Non-sheet Passing Portion |
| W ≤ 105 mm | Non-sheet Passing Portion | Non-sheet Passing Portion | Non-sheet Passing Portion | Sheet Passing Portion | Non-sheet Passing Portion | Non-sheet Passing Portion | Non-sheet Passing Portion |

When the target temperature of the "non-sheet passing portion" is set to a significantly low value, however, the slidability of the grease applied to the sliding surfaces of the film 202 and the heater 1100 is lost to increase the torque, which hinders the rotation of the film 202. It is concerned as a result that recording materials may not be stably conveyed. When the temperature of the film 202 falls below 110° C., the rotation of the film 202 is adversely affected, and hence, in the configuration of the present embodiment, the target temperature of the "non-sheet passing portion" is set to 120° C., which has a margin to 110° C. by 10° C.

As a comparative example of the present embodiment, there is described a case in which, as in the related art, the temperature of each heat generating block is controlled with the thermistor close to the sheet passing reference regardless of the width of a recording material (the width of a feeding sheet in the longitudinal direction of the fixing apparatus). The thermistor that is used for controlling the temperature of each heat generating block is as in Table 2 below.

TABLE 2

| Recording Material Width W | HB11 | HB12 | HB13 | HB14 | HB15 | HB16 | HB17 |
|---|---|---|---|---|---|---|---|
| 210 mm < W | Sheet Passing | Sheet Passing | Sheet Passing | Sheet Passing | Sheet Passing | Sheet Passing | Sheet Passing |

TABLE 2-continued

| Recording Material Width W | HB11 | HB12 | HB13 | HB14 | HB15 | HB16 | HB17 |
|---|---|---|---|---|---|---|---|
| | Portion T1-C | Portion T2-C | Portion T3-C | Portion T4-C | Portion T5-C | Portion T6-C | Portion TC-7 |
| 185 mm < W ≤ 210 mm | Non-sheet Passing Portion | Sheet Passing Portion | Sheet Passing Portion | Sheet Passing Portion | Sheet Passing Portion | Sheet Passing Portion | Non-sheet Passing Portion |
| | T1-C | T2-C | T3-C | T4-C | T5-C | T6-C | TC-7 |
| 105 mm < W ≤ 185 mm | Non-sheet Passing Portion | Non-sheet Passing Portion | Sheet Passing Portion | Sheet Passing Portion | Sheet Passing Portion | Non-sheet Passing Portion | Non-sheet Passing Portion |
| | T1-C | T2-C | T3-C | T4-C | T5-C | T6-C | TC-7 |
| W ≤ 105 mm | Non-sheet Passing Portion | Non-sheet Passing Portion | Non-sheet Passing Portion | Sheet Passing Portion | Non-sheet Passing Portion | Non-sheet Passing Portion | Non-sheet Passing Portion |
| | T1-C | T2-C | T3-C | T4-C | T5-C | T6-C | TC-7 |

In this example, a case in which A5 size sheets (a width of 148 mm) are successively fed is considered. The printer 100 used in the present embodiment is a printer capable of feeding 70 A5 size sheets per minute (=70 ppm: paper per minute). FIG. 4A to FIG. 4C illustrate the longitudinal distribution of the target temperature and the film temperature of the heat generating blocks in this case. The heat generating blocks HB14 to HB17, which are symmetric to each other with respect to the sheet passing reference, are used for description.

FIG. 4A is a schematic diagram illustrating a longitudinal positional relationship between the heat generating blocks, the thermistors, and an A5 sheet. In each heat generating block, the thermistors that are used for the temperature control are represented as hatched portions.

FIG. 4B illustrates temperature distribution in the longitudinal direction after some A5 sheets have been fed, and the solid line indicates the distribution of the target temperature, whereas the dashed line indicates the distribution of the film temperature. Of the heat generating blocks, the heat generating blocks HB14 and HB15 through which the A5 sheet passes is controlled to a temperature (170° C. in the present embodiment) for fixing a toner image to be printed. The temperature of the heat generating block HB15 corresponding to the sheet end position of the A5 sheet is controlled so that the thermistor T5-C included in the sheet passing region of the A5 sheet reaches 170° C., and hence, the film temperature in the non-sheet passing portion of the A5 sheet reaches a temperature greater than the target temperature due to the effect of non-sheet passing portion temperature rise.

The heat generating blocks HB16 and HB17 corresponding to the non-sheet passing portion are controlled to a low temperature (120° C. in the present embodiment) in the light of energy saving. The non-sheet passing portion temperature rise in the heat generating block HB15 propagates, however, to the heat generating block HB16. The thermistor T6-C, which is adjacent to the heat generating block HB15, is, therefore affected by the non-sheet passing portion temperature rise, and thus, detects a temperature greater than the non-sheet passing portion target temperature. Because the heat generating block HB16 is controlled so that the temperature of the thermistor T6-C reaches the non-sheet passing portion target temperature, the amount of heat generation is reduced. Thus, when the sheet feeding continues, the film temperature shows the distribution indicated by the dashed line in FIG. 4C, and the temperature in a part of the heat generating block HB16 is lowered to 100° C., which is lower than 110° C., which is a lower-limit temperature necessary for the film 202 to rotate. As a result, the slidability of the grease for helping the rotation of the film 202 is lost to increase the torque, which hinders the rotation of the film 202. Consequently, the recording material P may not be stably conveyed.

Figure 5:
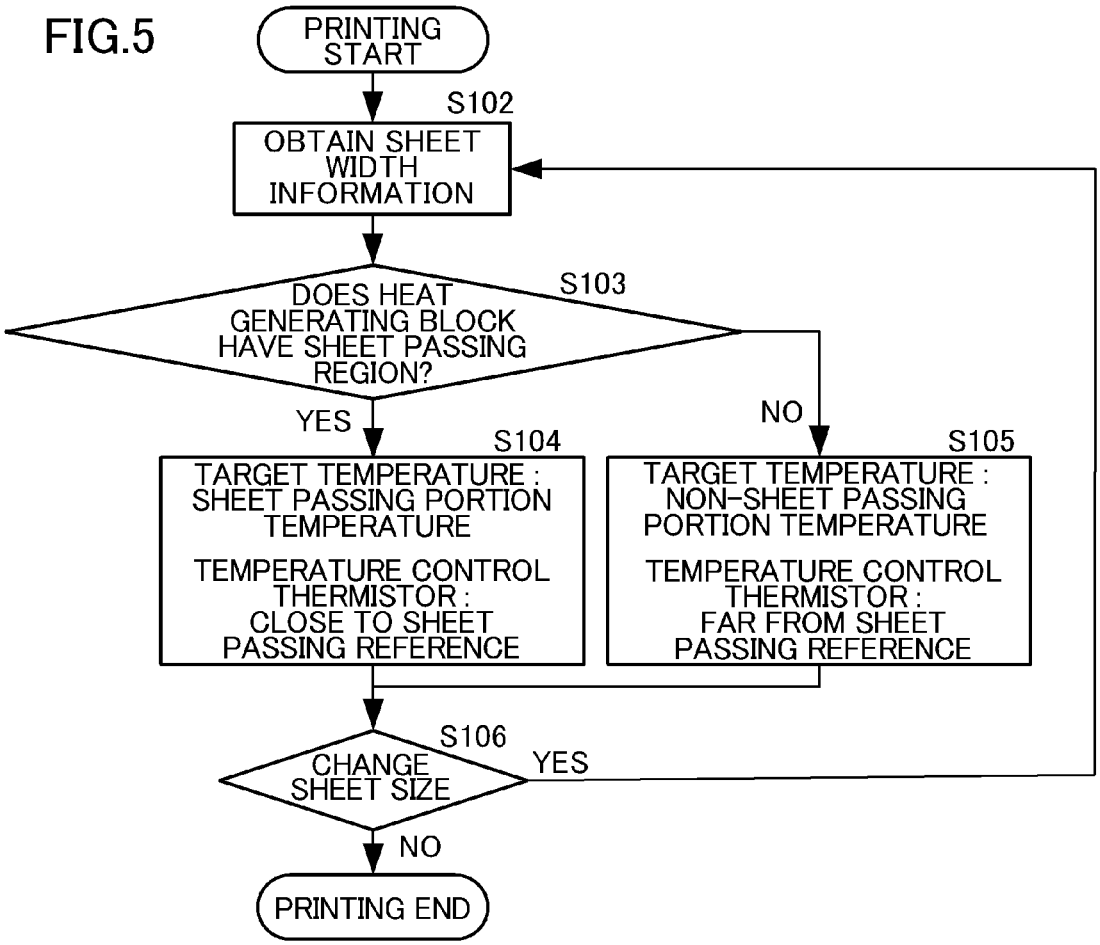
FIG. 5 is a flowchart illustrating Embodiment 1.

In order to solve this problem, in the present embodiment, as illustrated in the flowchart of FIG. 5, the thermistor that is used for the temperature control is switched with the use of the width information on a recording material. Specifically, when receiving the job of print start (image formation start), the control portion of the image forming apparatus obtains the width information on a recording material (S102), and determines whether each heat generating block has the sheet passing region or not (S103). A heat generating block (sheet-passing heating region) corresponding to the sheet passing portion is set so that the temperature of the heat generating block is controlled with a thermistor close to the sheet passing reference (S104), and a heat generating block (non-sheet-passing heating region) corresponding to the non-sheet passing portion is set so that the temperature of the heat generating block is controlled with a thermistor far from the sheet passing reference (S105). This control is executed every time the size of recording materials is changed (S106). Table 3 is a correlation table of a sheet width and a thermistor that controls each heat generating block in the present embodiment.

TABLE 3

| Recording Material Width W | HB11 | HB12 | HB13 | HB14 | HB15 | HB16 | HB17 |
|---|---|---|---|---|---|---|---|
| 210 mm < W | Sheet Passing Portion T1-C | Sheet Passing Portion T2-C | Sheet Passing Portion T3-C | Sheet Passing Portion T4-C | Sheet Passing Portion T5-C | Sheet Passing Portion T6-C | Sheet Passing Portion TC-7 |

TABLE 3-continued

| Recording Material Width W | HB11 | HB12 | HB13 | HB14 | HB15 | HB16 | HB17 |
|---|---|---|---|---|---|---|---|
| 185 mm < W ≤ 210 mm | Non-sheet Passing Portion T1-E | Sheet Passing Portion T2-C | Sheet Passing Portion T3-C | Sheet Passing Portion T4-C | Sheet Passing Portion T5-C | Sheet Passing Portion T6-C | Non-sheet Passing Portion TC-E |
| 105 mm < W ≤ 185 mm | Non-sheet Passing Portion T1-E | Non-sheet Passing Portion T2-E | Sheet Passing Portion T3-C | Sheet Passing Portion T4-C | Sheet Passing Portion T5-C | Non-sheet Passing Portion T6-E | Non-sheet Passing Portion TC-E |
| W ≤ 105 mm | Non-sheet Passing Portion T1-E | Non-sheet Passing Portion T2-E | Non-sheet Passing Portion T3-E | Sheet Passing Portion T4-C | Non-sheet Passing Portion T5-E | Non-sheet Passing Portion T6-E | Non-sheet Passing Portion TC-E |

Table 3 shows the following.

When the recording material width W satisfies W>210 mm, all the heat generating blocks correspond to the sheet passing portion, and hence, in each of the heat generating blocks HB11 to HB17, the control is performed with the thermistor close to the sheet passing reference in each heat generating block.

When the recording material width W satisfies 185 mm<W≤210 mm, in the heat generating blocks HB12 to HB16 that are heat generating blocks through which the recording material passes, the control is performed with the thermistors T2-C to T6-C close to the sheet passing reference in the respective heat generating blocks. Further, in the heat generating blocks HB11 and HB17 corresponding to the non-sheet passing portion, the control is performed with the thermistors T1-E and T7-E far from the sheet passing reference.

When the recording material width W satisfies 105 mm<W≤185 mm, in the heat generating blocks HB13 to HB15 that are heat generating blocks through which the recording material passes, the control is performed with the thermistors T3-C to T5-C close to the sheet passing reference in the respective heat generating blocks. Further, in the heat generating blocks HB11, HB12, HB16, and HB17 corresponding to the non-sheet passing portion, the control is performed with the thermistors T1-E, T2-E, T6-E, and T7-E far from the sheet passing reference.

When the recording material width satisfies W≤105 mm, in the heat generating block HB14 that is a heat generating block through which the recording material passes, the energization control is performed with the thermistor T4-C close to the sheet passing reference. In the remaining heat generating blocks HB11 to HB13 and HB15 to HB17, which correspond to the non-sheet passing portion, the control is performed with the thermistors T1-E to T3-E and T5-E to T7-E far from the sheet passing reference.

A case in which A5 size sheets (a width of 148 mm) are successively fed while the control of the present embodiment is performed is considered. FIG. 6A is a schematic diagram illustrating a longitudinal positional relationship between the heat generating blocks, the thermistors, and an A5 sheet when the control of the present embodiment is performed. In each heat generating block, the thermistors that are used for the temperature control are represented as hatched portions. The thermistors that are used for controlling the temperatures of the heat generating blocks HB16 and HB17 are different from those used in the comparative example (FIG. 4A to FIG. 4C).

FIG. 6B illustrates the longitudinal distribution of the target temperature and the film temperature of the heat generating blocks. The heat generating blocks HB14 to HB17, which are symmetric to each other with respect to the sheet passing reference, are used for description. Temperature distribution after some sheets have been fed is the same as that in FIG. 4B, and the film temperature in the non-sheet passing portion of the A5 sheet in the heat generating block HB15 reaches a temperature greater than the target temperature due to the effect of the non-sheet passing portion temperature rise. This non-sheet passing portion temperature rise propagates to the heat generating block HB16. The thermistor T6-C, which is adjacent to the heat generating block HB15, is, therefore, affected by the non-sheet passing portion temperature rise, and thus, detects a temperature greater than the non-sheet passing portion target temperature. Meanwhile, the thermistor T6-E far from the heat generating block HB15 is not affected by the non-sheet passing portion temperature rise, and is thus, at 120° C. that is the same as the non-sheet passing portion target temperature.

In the present embodiment, the heat generating block HB16 is controlled with the thermistor T6-E. Thus, even when the sheet feeding continues, the amount of heat generation in the heat generating block HB16 is not changed, and the entire region of the heat generating block HB16 can always be maintained at the target temperature or greater, as illustrated in FIG. 6C.

A similar effect can be obtained in the heat generating block HB12 that is opposite to the heat generating block HB16 with respect to the conveyance reference line X in the longitudinal direction. Consequently, a conveyance failure of recording materials that occurs when the film temperature falls below the non-sheet passing portion target temperature can be prevented.

The printer of the present embodiment obtains, before starting sheet feeding, sheet width information that is set by a user. The method for obtaining sheet width information can be selected from, for example, a method for determining a width with sheet-width sensors provided to the sheet-feeding cassette and the sheet-feeding tray, and a method for determining a width with the use of a sensor, such as a flag, provided on the sheet conveyance path.

When width information is obtained on the conveyance path, first, as of print start, the temperature control is performed with the thermistors close to the sheet passing reference in all the heat generating blocks. Then, when a sheet arrives at the position of the sensor and sheet width information is determined, the control in a heat generating block corresponding to the non-sheet passing portion is switched to the one with the thermistor far from the sheet passing reference. In this way, a similar effect can be obtained.

Further, in the example described in the present embodiment, control is performed in which the thermistor that is used for controlling the temperature of the non-sheet passing portion is switched to the thermistor far from the sheet passing reference when sheet width information is determined, but the switching timing may not be a timing at which sheet width information is determined. The following method may be employed, for example: first, the temperature control is performed with the thermistor close to the sheet passing reference, and the control is switched when the thermistor far from the sheet passing reference falls below a predetermined temperature.

In the present embodiment, the image heating apparatus in which the conveyance reference position of recording materials is at the longitudinal center of the image forming apparatus is described, but in an apparatus in which the reference position is not at the center and a recording material is conveyed at a position closer to one side than other side, a similar effect can be obtained through the same control as that in the present embodiment. Further, in the present embodiment, the target temperature of the sheet passing portion is set to 170° C., and the target temperature of the non-sheet passing portion is set to 120° C., but target temperatures are not limited to the temperatures in the present embodiment either.

As described above, the temperature of a heat generating block corresponding to the non-sheet passing portion is controlled with the thermistor far from the sheet passing reference, with the result that the entire longitudinal region of the heat generating block can be maintained at the lower-limit temperature, which is necessary for the film rotation, or greater, and recording materials can thus be stably conveyed.

Embodiment 2

As Embodiment 1, there is described the method in which, in a heat generating block that corresponds to the non-sheet passing portion, and thus has a low film temperature in a region far from the sheet passing reference, the thermistor that is used for the control is switched to the thermistor far from the sheet passing reference so that a predetermined temperature is maintained. In Embodiment 2, there is described an example in which the thermistor that is used for the temperature control is not switched from the thermistor close to the sheet passing reference as in the example shown in Table 2, and each heat generating block is maintained at a predetermined temperature or higher by another method. Description of the same matters as those in Embodiment 1, such as the apparatus configuration, is omitted.

Figure 7:
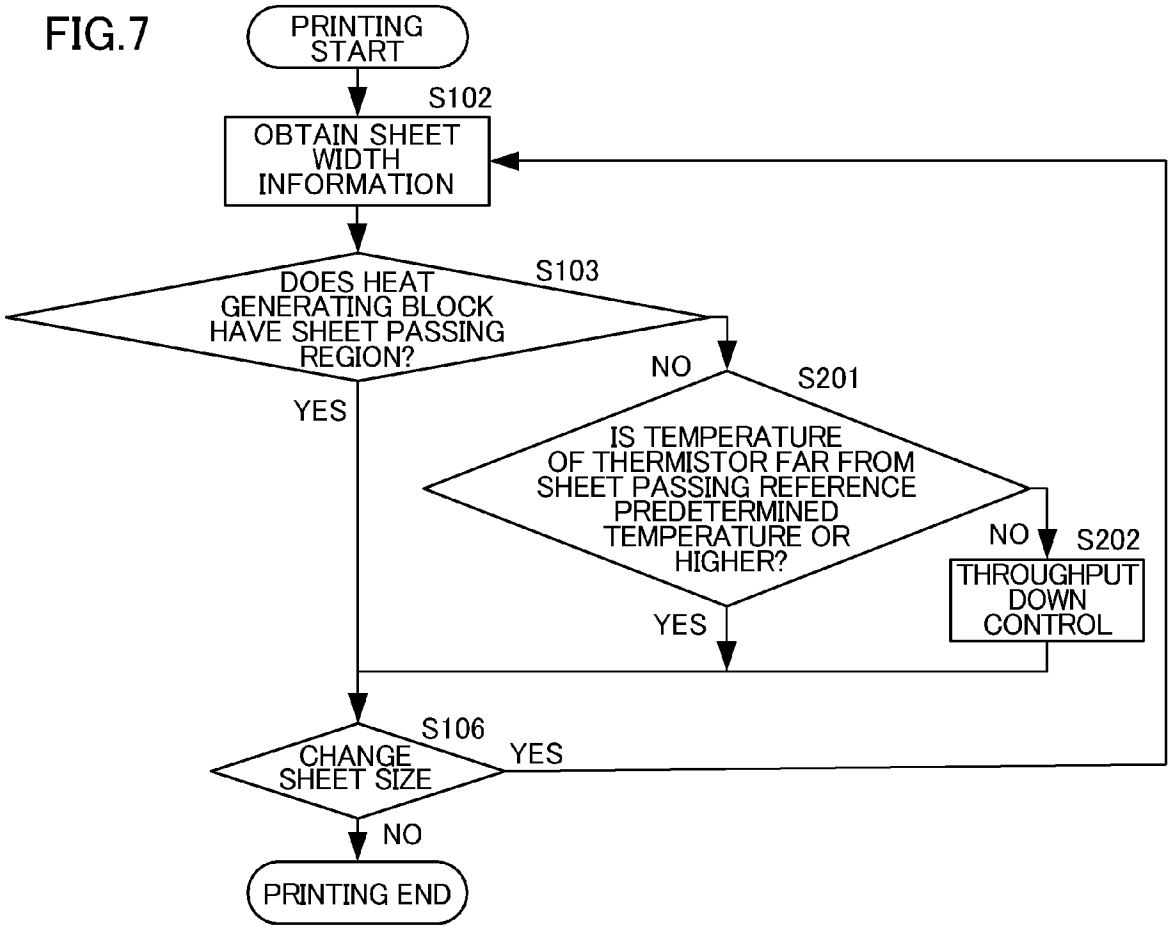
FIG. 7 is a flowchart illustrating Embodiment 2.

As in Embodiment 1, a case in which A5 size sheets (a width of 148 mm) are successively fed is considered. When sheet feeding of the A5 sheets continues, as illustrated in FIG. 4C, a heat generating block corresponding to the non-sheet passing portion has, at a position far from the sheet passing reference, a film surface temperature falling below the non-sheet passing portion target temperature. As a measure against this, in the present embodiment, as illustrated in the flowchart of FIG. 7, a temperature detected by a thermistor that is included in the heat generating block corresponding to the non-sheet passing portion and is far from the sheet passing reference is monitored (S201). Then, when the temperature falls below a predetermined temperature, control (throughput down control) for increasing sheet-feeding intervals is performed (S202).

Also in the present embodiment, the heat generating blocks HB14 to HB17, which are symmetric to each other, are used for description. When the A5 sheet is fed, the temperature of the thermistor T6-E, which is a thermistor included in the heat generating block HB16 corresponding to the non-sheet passing portion and is far from the sheet passing reference, is monitored. Then, when a temperature detected by the thermistor T6-E falls below 120° C., which is the non-sheet passing portion target temperature, a measure is taken to increase the sheet-feeding intervals (conveyance intervals between recording materials when images are formed successively on a plurality of recording materials). Specifically, when the temperature of the thermistor T6-E falls below 120° C., control for reducing the throughput of the A5 sheets from 70 ppm to 35 ppm is performed.

Figure 8:
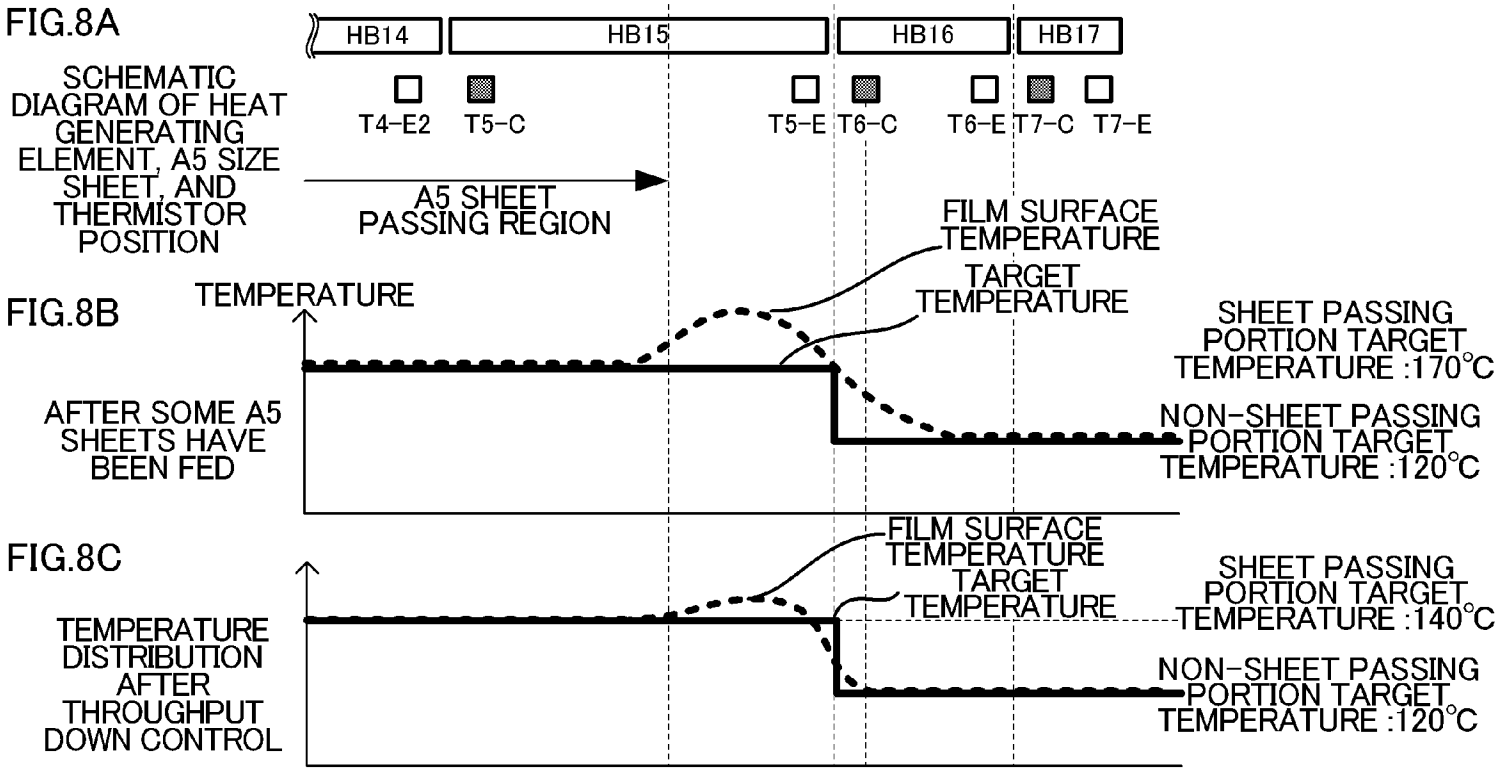
FIG. 8A to FIG. 8C illustrate temperature distribution of Embodiment 2.

FIG. 8A is a schematic diagram illustrating a longitudinal positional relationship between the heat generating blocks, the thermistors, and an A5 sheet. FIG. 8B illustrates the longitudinal distribution of the target temperature and the film temperature after some A5 sheets have been fed. FIG. 8C illustrates the longitudinal distribution of the target temperature and the film temperature after the throughput down control. When the throughput is reduced, the target temperature of the sheet passing portion can be lowered. This is because when the throughput is reduced, an interval between sheets is increased and the pressure roller and other members thus store heat, with the result that a toner image can be fixed with the heat from the other members even when the film temperature is low. In the present embodiment, the target temperature of the sheet passing portion when sheets are fed at 35 ppm is set to 140° C.

When the target temperature of the sheet passing portion is set to 140° C. and the target temperature of the non-sheet passing portion is set to 120° C., a target temperature difference between the sheet passing portion and the non-sheet passing portion is small, and hence, the amount of heat that propagates from the heat generating block HB15 to the heat generating block HB16 is reduced. Further, when an interval between sheets is increased through the throughput down control, the non-sheet passing portion temperature rise in the heat generating block HB15 is reduced. With the two effects described above, the amount of heat that propagates from the heat generating block HB15 to the heat generating block HB16 is remarkably small as compared to a case in which sheets are fed at 70 ppm. As a result, as illustrated in FIG. 8C, even the film temperature at the position of the thermistor T6-C is hardly changed from 120° C., which is the target temperature. Thus, even when the temperature of the heat generating block HB16 is controlled with the thermistor T6-C, the amount of heat generation is not reduced, and hence, the entire region of the heat generating block HB16 can be maintained at 120° C., which is the target temperature, or greater.

The advantage of selecting the method of Embodiment 2 is that the choice of components that can be used in the image heating apparatus is widened. When the method of Embodiment 1 is employed, the temperature of the entire region of the heat generating block HB16 can be maintained at a predetermined temperature or greater, but the non-sheet passing portion of the heat generating block HB15 tends to have a high temperature. Thus, it is necessary that components that are affected by the non-sheet passing portion temperature rise have sufficiently high heat-resistant temperatures. When the method of Embodiment 2 is employed, on the other hand, the non-sheet passing portion temperature rise in the heat generating block HB15 can be reduced, and hence, components having low heat-resistant temperatures can be selected.

Embodiment 3

A method other than the throughput down control can be employed as the measure that is taken when the thermistor far from the sheet passing reference falls below a predetermined temperature in the case in which the thermistor that is used for controlling the temperature of a heat generating block corresponding to the non-sheet passing portion is not switched from the thermistor close to the sheet passing reference. Description of matters in Embodiment 3 that are common to those in Embodiments 1 and 2 is omitted.

Figure 9:
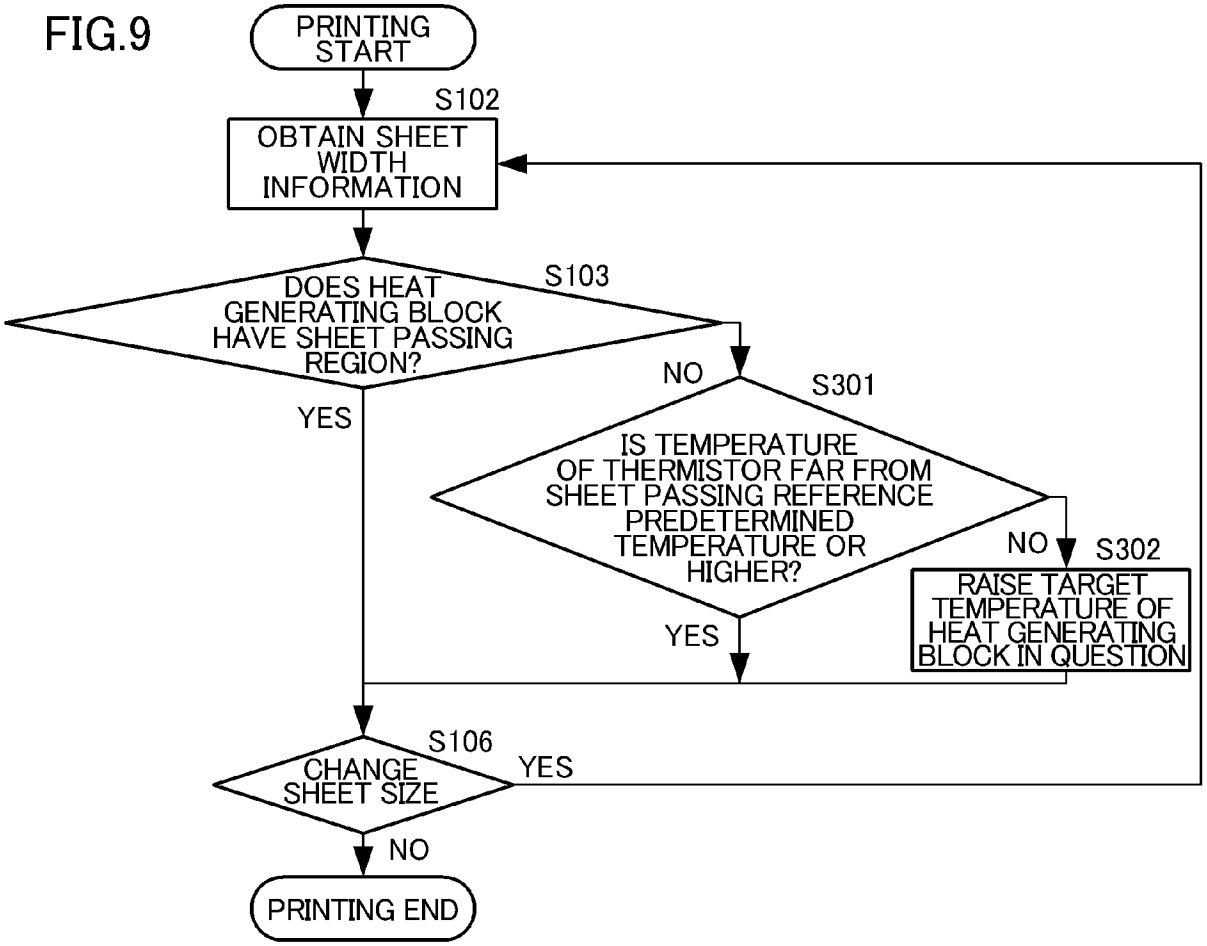
FIG. 9 is a flowchart illustrating Embodiment 3.
Figure 10:
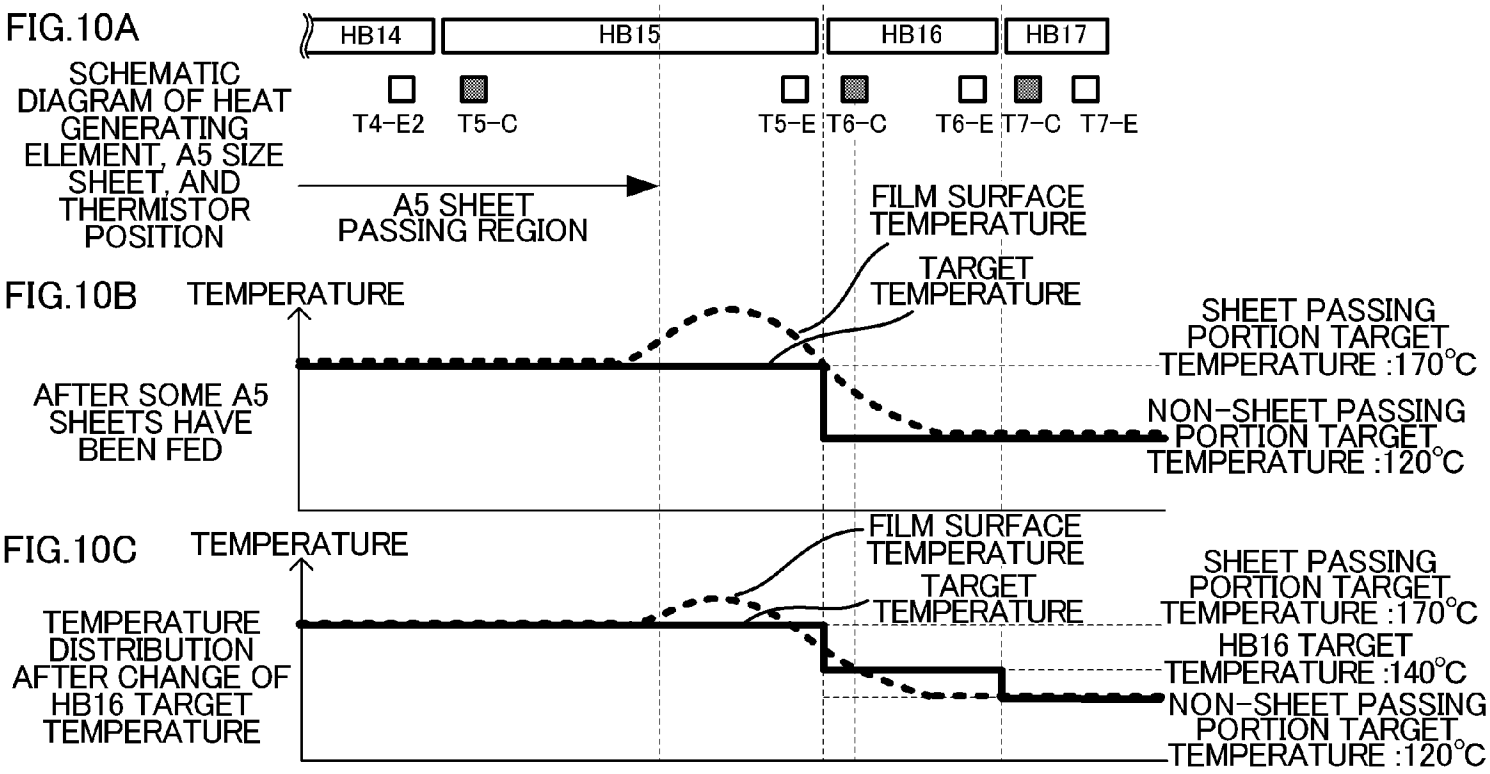
FIG. 10A to FIG. 10C illustrate temperature distribution of Embodiment 3.

In the present embodiment, as illustrated in the flowchart of FIG. 9, when a thermistor that is included in a heat generating block corresponding to the non-sheet passing portion and is far from the sheet passing reference falls below a predetermined temperature (S301), control for changing the target temperature to a high target temperature (S302) is performed. A case in which A5 sheets are successively fed by this method is described with reference to FIG. 10A to FIG. 10C. FIG. 10A is a schematic diagram illustrating a longitudinal positional relationship between the heat generating blocks, the thermistors, and an A5 sheet. FIG. 10B illustrates the longitudinal distribution of the target temperature and the film temperature after some A5 sheets have been fed. FIG. 10C illustrates the longitudinal distribution of the target temperature and the film temperature after the target temperature is changed.

When the A5 sheets are fed and the temperature distribution as illustrated in FIG. 10B is obtained, the amount of heat generation is reduced through control of the temperature of the thermistor T6-C, with the result that the temperature of the thermistor T6-E falls below a predetermined temperature. Here, the target temperature of the heat generating block HB16 (adjacent heating region) is changed to 140° C. that is a temperature between 170° C., which is the target temperature of the "sheet passing portion" (sheet-passing heating region), and 120° C., which is the target temperature of the "non-sheet passing portion" (non-adjacent heating region). When the sheet feeding continues under this state, as illustrated in FIG. 10C, the temperature at the position of the thermistor T6-C, which is subjected to the temperature control, is controlled to 140° C. that is a newly set target temperature of the heat generating block HB16. Meanwhile, the temperature at the position of the thermistor T6-E falls below 140° C., but can be maintained near 120° C., which is the same as the target temperature of the "non-sheet passing portion". Thus, the entire longitudinal region of the heat generating block HB16 can be maintained at 120° C. or higher, and a conveyance failure of recording materials can, therefore, be prevented.

Embodiment 4

In Embodiment 4, there is proposed still another method that may be employed as the measure that is taken when the thermistor far from the sheet passing reference falls below a predetermined temperature in the case in which the thermistor that is used for controlling the temperature of a heat generating block corresponding to the non-sheet passing portion is not switched from the thermistor close to the sheet passing reference. Description of matters in Embodiment 4 that are common to those in Embodiments 1 to 3 is omitted.

Figure 11:
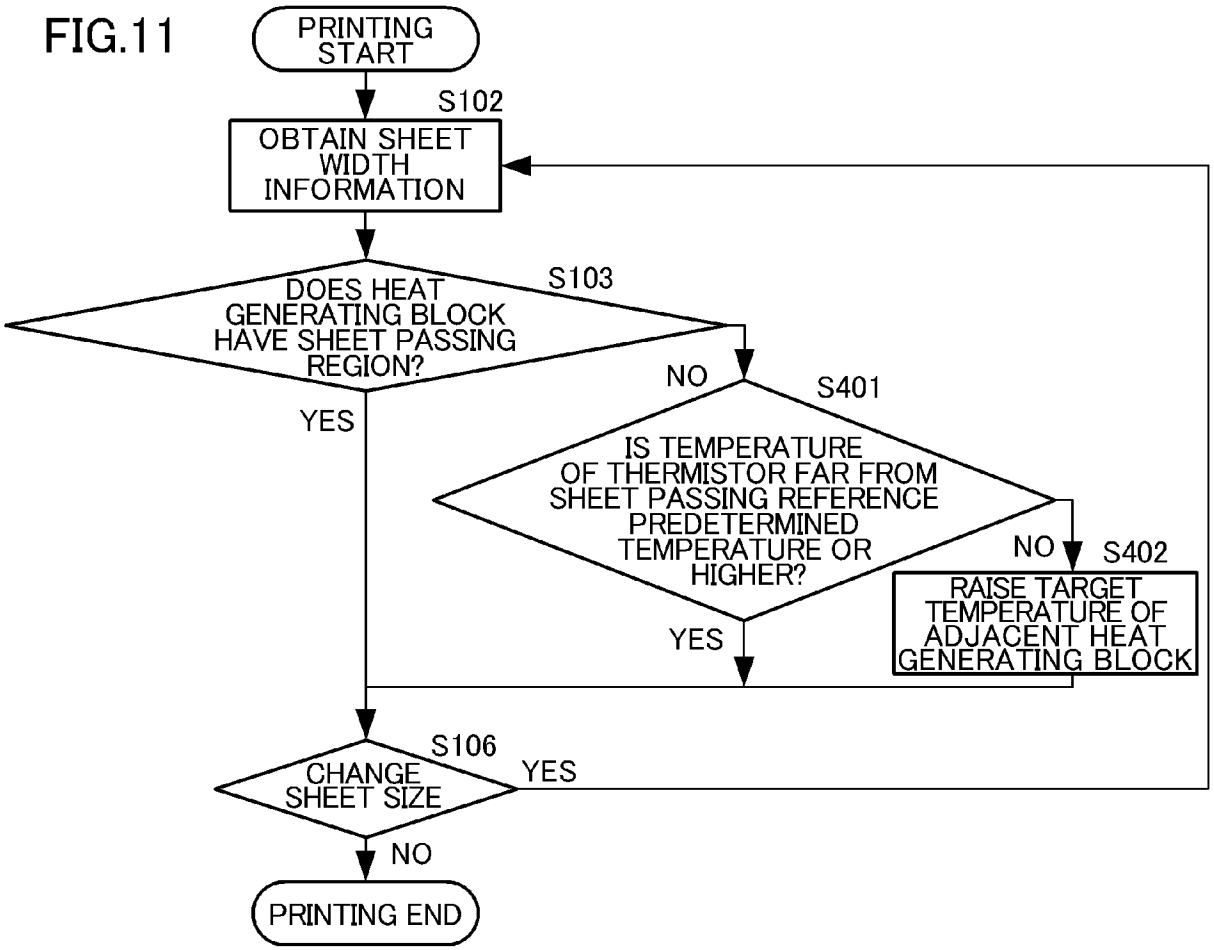
FIG. 11 is a flowchart illustrating Embodiment 4.
Figure 12:
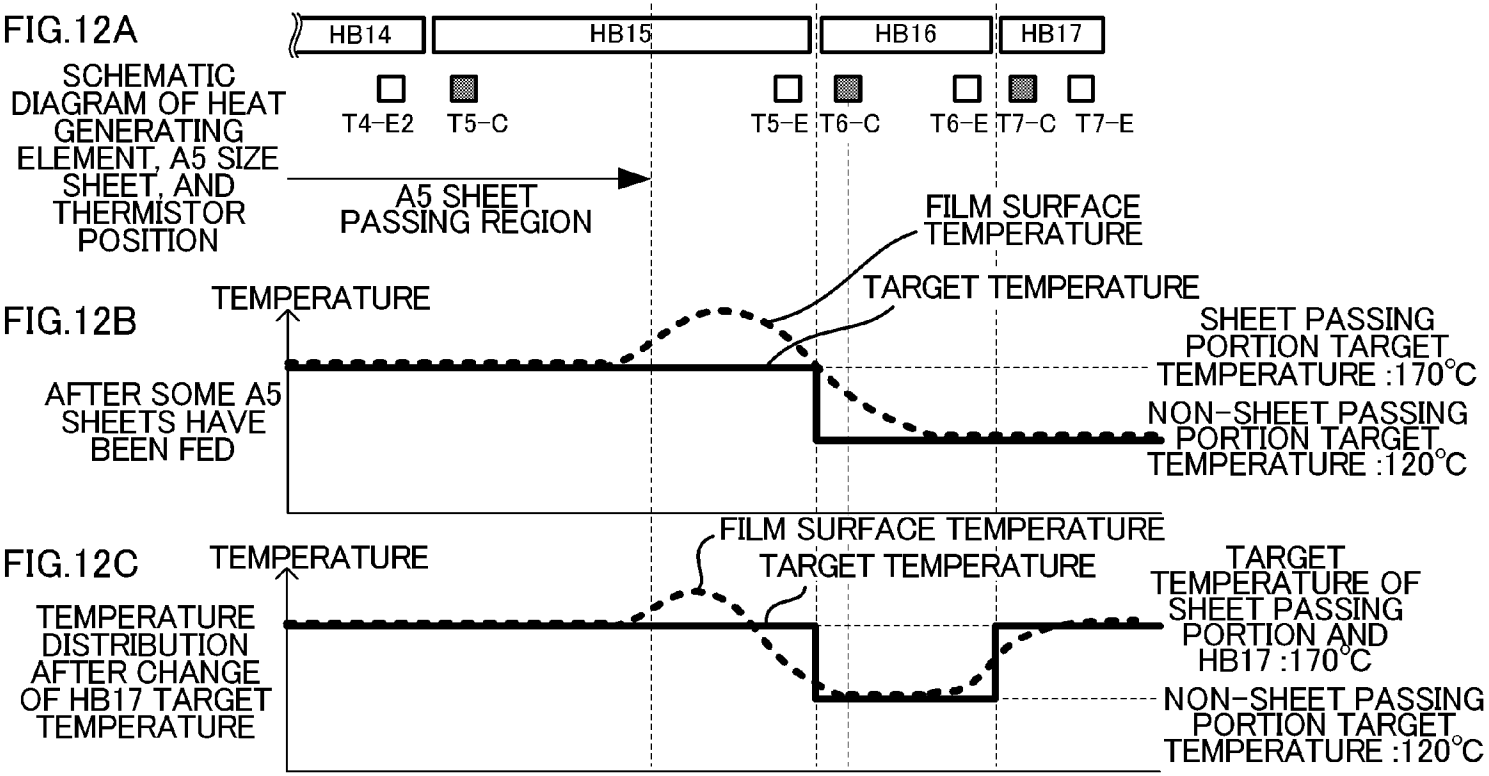
FIG. 12A to FIG. 12C illustrate temperature distribution of Embodiment 4.

In the present embodiment, as illustrated in the flowchart of FIG. 11, when a thermistor that is included in a heat generating block corresponding to the non-sheet passing portion and is far from the sheet passing reference falls below a predetermined temperature (S401), support control for increasing the target temperature of an adjacent heat generating block (S402) is performed. A case in which A5 sheets are successively fed by this method is described with reference to FIG. 12A to FIG. 12C. FIG. 12A is a schematic diagram illustrating a longitudinal positional relationship between the heat generating blocks, the thermistors, and an A5 sheet. FIG. 12B illustrates the longitudinal distribution of the target temperature and the film temperature after some A5 sheets have been fed. FIG. 12C illustrates the longitudinal distribution of the target temperature and the film temperature after the target temperature is changed.

When the A5 sheets are fed and the temperature distribution as illustrated in FIG. 12B is obtained, the amount of heat generation is reduced through control of the temperature of the thermistor T6-C, with the result that the temperature of the thermistor T6-E falls below a predetermined temperature. Here, the target temperature of the heat generating block HB17 adjacent to the thermistor T6-E is raised to 170° C., which is the same as the target temperature of the "sheet passing portion". As a result, as illustrated in FIG. 12C, the heat of the heat generating block HB17 propagates to the heat generating block HB16, and the entire region of the heat generating block HB16 can be maintained at 120° C. or greater.

As described so far, the temperature of a thermistor that is included in a heat generating block corresponding to the non-sheet passing portion and is far from the sheet passing reference is monitored, and, when the temperature falls below a predetermined temperature, the measure is taken. Consequently, the entire region of the heat generating block can be maintained at a predetermined temperature or greater, and a conveyance failure of recording materials can, therefore, be prevented.

Embodiment 5

In the present embodiment, there is described an example in which the temperature control is switched on the basis of the width of a toner image to be formed on a recording material, instead of the width of a recording material. Description of the same matters as those in Embodiment 1, such as the apparatus configuration, is omitted.

In the fixing apparatus having the heat generating blocks, which are obtained through division in the longitudinal direction, control for achieving energy saving is performed by performing the temperature control depending on the presence or absence of a toner image in the sheet passing region. Specifically, the temperature of a portion of the sheet passing region in which a toner image is present is raised to a temperature necessary for fixing the toner image, and the temperature of a portion of the sheet passing region in which the toner image is not present is lowered to the lower-limit temperature necessary for the film rotation.

Figure 13:
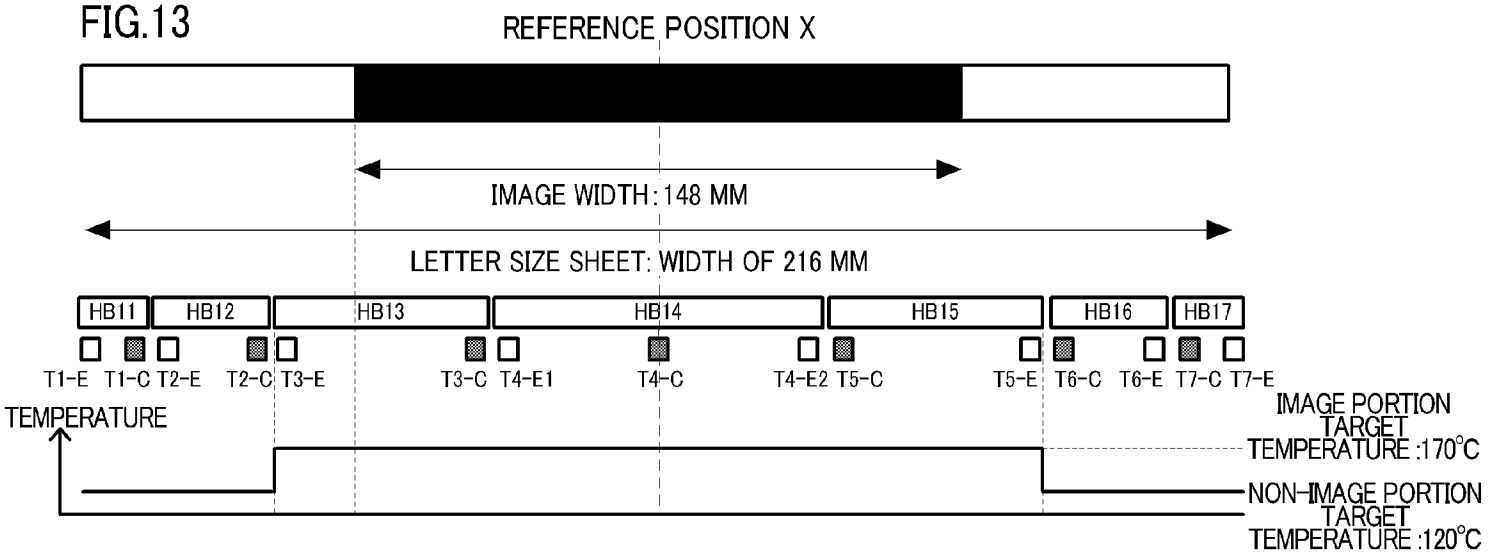
FIG. 13 illustrates a toner image on a feeding sheet in Embodiment 5.

For example, when an image having a width of 148 mm is printed on a letter size sheet having a width of 216 mm as illustrated in FIG. 13, the heat generating blocks HB13 to HB15 (image heating regions) through which the image passes are controlled to an image portion target temperature (170° C.) for fixing a toner image. Meanwhile, the heat generating blocks HB11, HB12, HB16, and HB17 (non-image heating regions), through which the image does not pass, is controlled to a non-image portion target temperature (120° C.), which is the lower-limit temperature necessary for the film 202 to rotate.

In the related art, in the heat generating block HB14, which is a heat generating block whose entire region corresponds to an image portion, the temperature control is performed with the thermistor T4-C close to the sheet passing reference position X. Further, in the heat generating blocks HB13 and HB15, which are heat generating blocks partly corresponding to the image portion, the temperature control is performed with the thermistors T3-C and T5-C included in a printing region in order to ensure the fixing performance in the printing region. In addition, in the heat generating blocks HB11, HB12, HB16, and HB17, which are heat generating blocks whose entire regions correspond to a non-image portion, the temperature control is performed with the thermistors T1-C, T2-C, T6-C, and T7-C close to the sheet passing reference X. When a heat generating block corresponding to the non-image portion is controlled with the thermistor close to the sheet passing reference X as in the related art, however, a problem similar to the one in the related art, which is described in Embodiment 1, arises.

Figure 14:
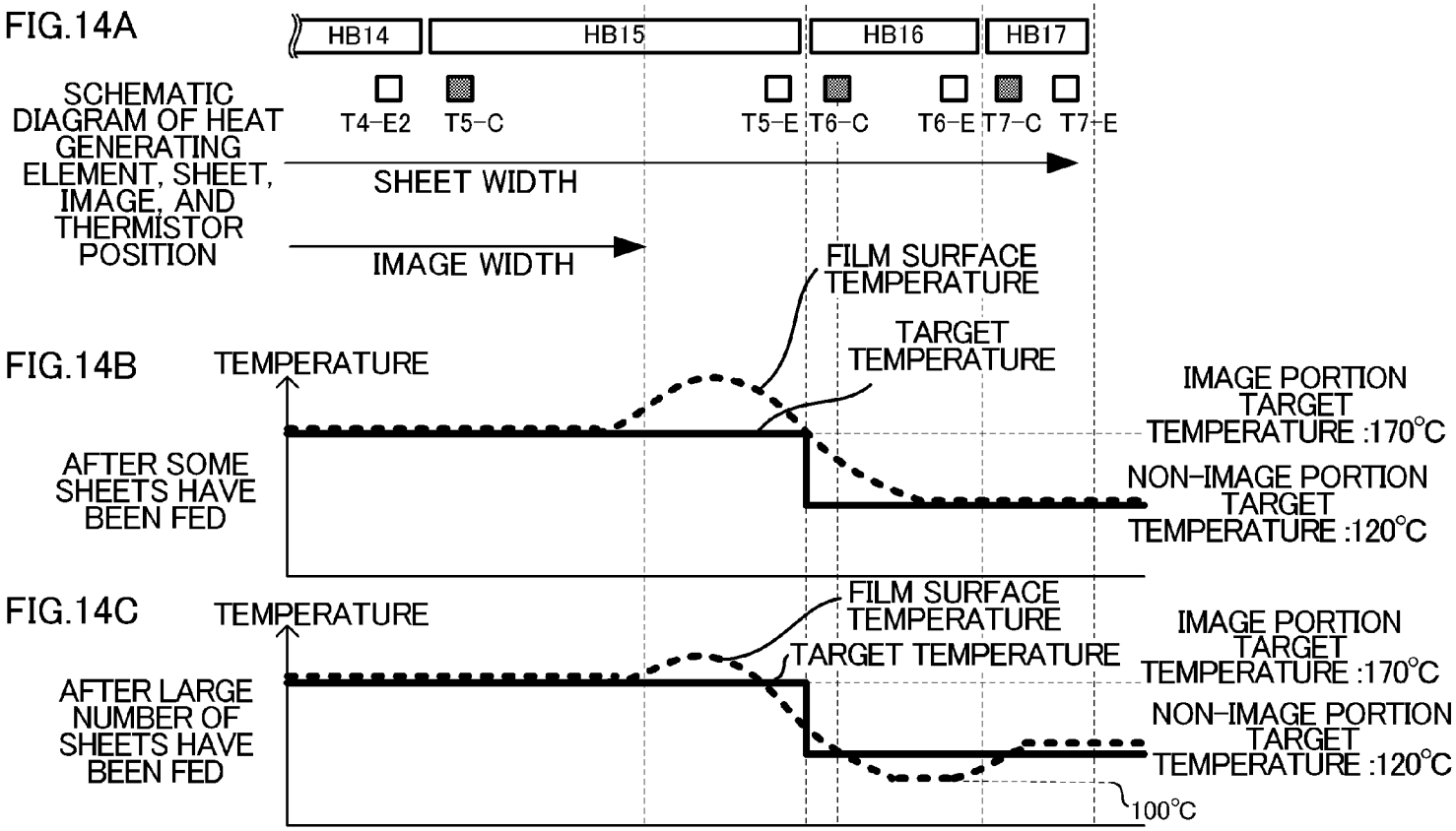
FIG. 14A to FIG. 14C illustrate temperature distribution of comparative example of Embodiment 5.

FIG. 14A is a schematic diagram illustrating a longitudinal positional relationship between a sheet, an image width, and thermistor positions in a case in which an image having a width of 148 mm is printed on a letter size sheet having a width of 216 mm as illustrated in FIG. 13, with the use of the related-art control. Further, FIG. 14B illustrates the longitudinal distribution of the target temperature and the film temperature after some of the above-mentioned letter size sheets have been fed. In addition, FIG. 14C illustrates the longitudinal distribution of the target temperature and the film temperature after the sheet feeding is continuously performed. Also in the present example, the heat generating blocks HB14 to HB17, which are symmetric to each other with respect to the sheet passing reference, are used for description. In FIG. 14A, the thermistors that are used for the temperature control are represented as hatched portions.

Of the heat generating blocks, the heat generating blocks HB14 and HB15 through which the image passes are controlled to a temperature (image portion target temperature: 170° C.) for fixing a toner image. Here, the temperature of the heat generating block HB15, through which the end position of the image passes, is controlled so that the thermistor T5-C in the image reaches 170° C.

The sheet and the toner both take the heat from the film in the region in which the toner image is present, but in the region in which the toner image is not present, only the sheet takes the heat, which means that the heat is consumed a little. Thus, as illustrated in FIG. 14B, the heat generating block HB15 has, in a portion in which the image is not present, a film temperature greater than the target temperature.

The heat generating blocks HB16 and HB17 corresponding to the non-sheet passing portion are controlled to the lower-limit temperature (non-image portion target temperature: 120° C.) necessary for the film rotation in the light of energy saving. The heat of the heat generating block HB15, which has a greater temperature than the heat generating block HB16 and causes temperature rise in the non-image portion, propagates, however, to the heat generating block HB16, and hence, the thermistor T6-C adjacent to the heat generating block HB15 detects a temperature greater than the target temperature. Because the heat generating block HB16 is controlled so that the temperature of the thermistor T6-C reaches the non-image portion target temperature, the amount of heat generation is reduced. Thus, when the sheet feeding continues, the temperature distribution as illustrated in FIG. 14C is obtained. A temperature near the thermistor T6-E is lowered to 100° C., which is less than 110° C., which is the lower-limit temperature necessary for the film 202 to rotate. Thus, the viscosity of the grease for helping the rotation of the film 202 is lost to increase the torque, which hinders the rotation of the film 202. It is thus possible that a conveyance failure of the recording material P may occur.

Figure 15:
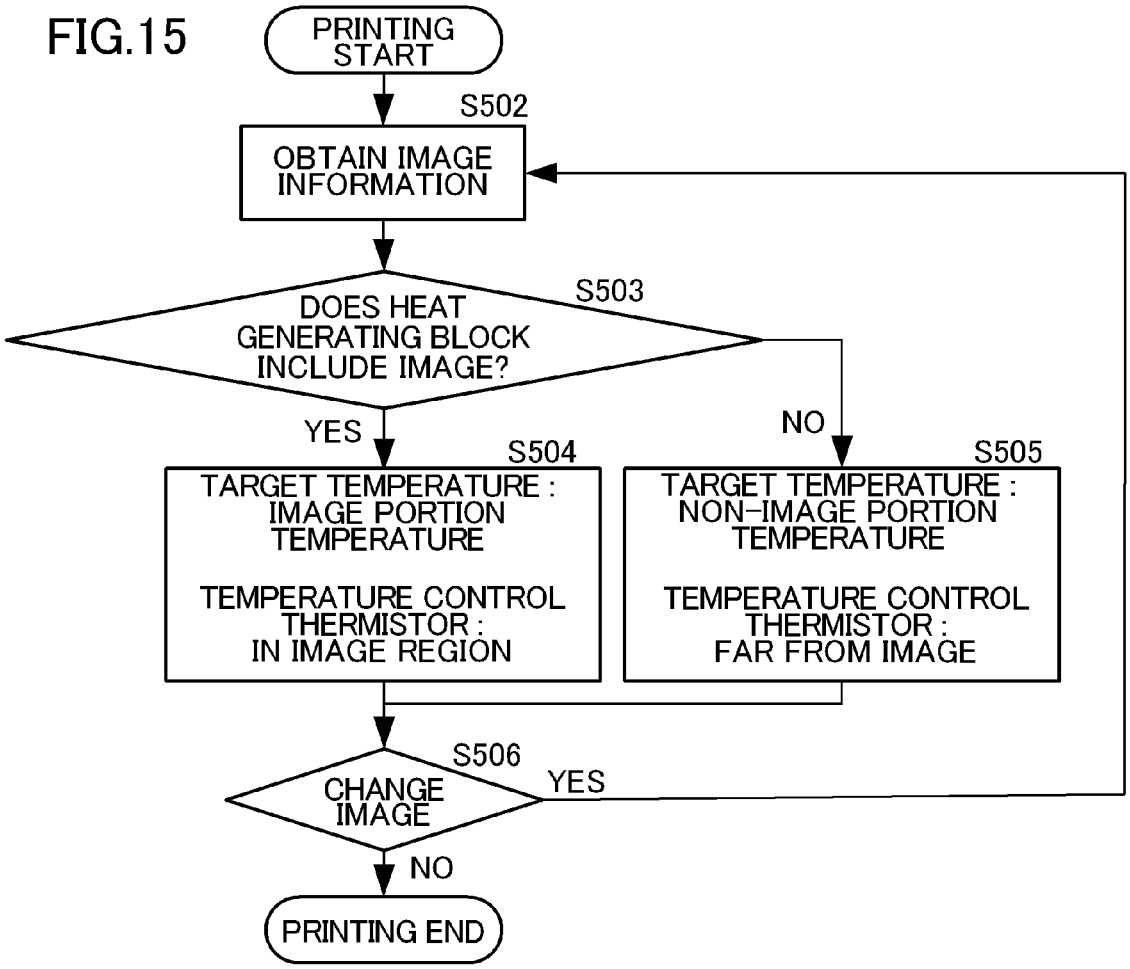
FIG. 15 is a flowchart illustrating Embodiment 5.

In order to solve this problem, in the present embodiment, as illustrated in the flowchart of FIG. 15, control for switching the thermistor that is used for controlling the temperature of a heat generating block corresponding to the non-image portion to the thermistor far from an image is performed. Specifically, when receiving the job of print start (image formation start), the control portion of the image forming apparatus obtains information on an image to be formed on a recording material (S502), and determines whether each heat generating block has the image portion through which the image passes (S503). A heat generating block corresponding to the image portion is set so that the temperature of the heat generating block is controlled with the thermistor close to the sheet passing reference (S504), and a heat generating block corresponding to the non-image portion is set so that the temperature of the heat generating block is controlled with the thermistor far from the sheet passing reference (S505). This control is executed every time images are changed (S506).

Figure 16:
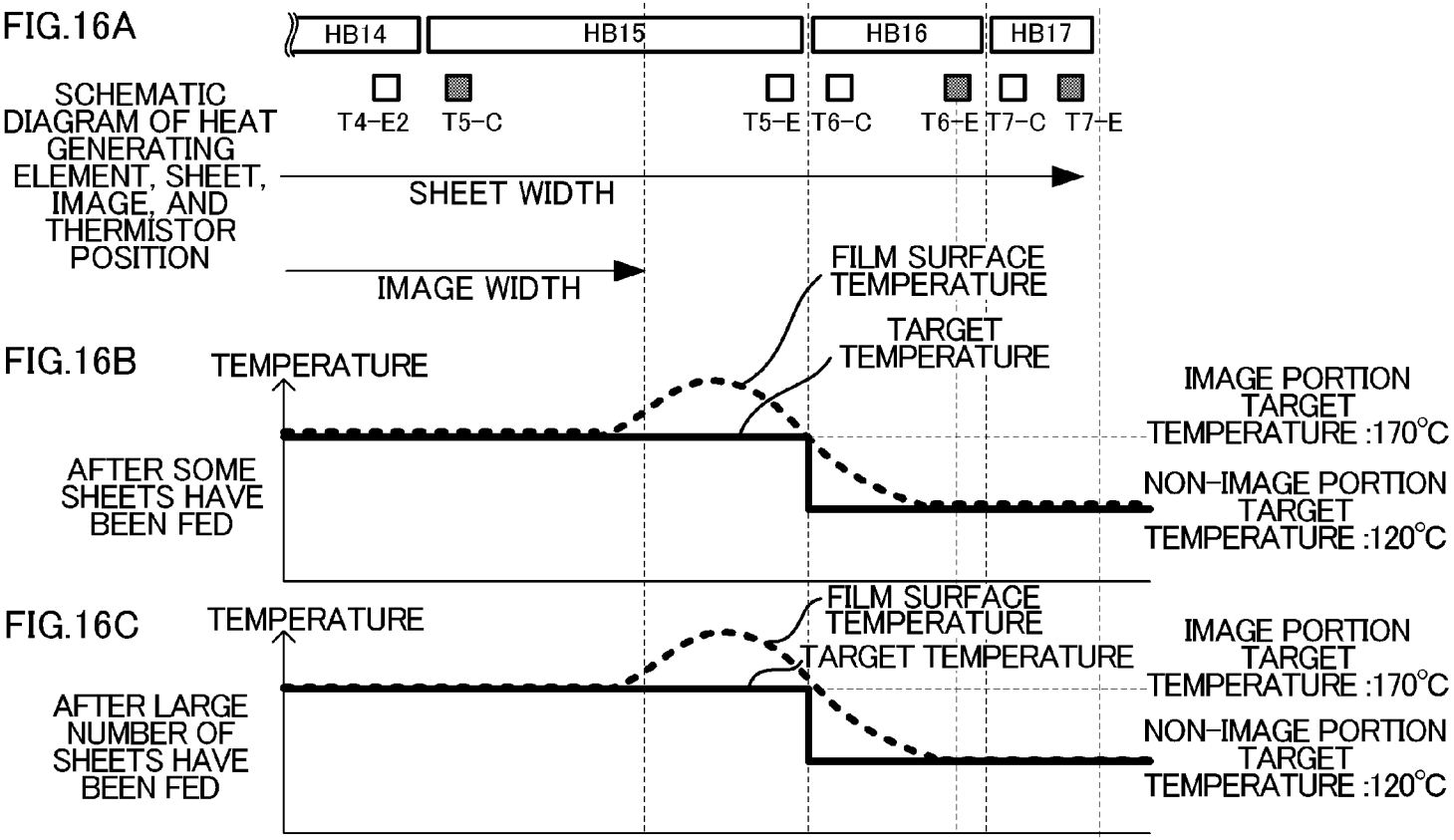
FIG. 16A to FIG. 16C illustrate temperature distribution of Embodiment 5.

FIG. 16A is a schematic diagram illustrating a longitudinal positional relationship between a sheet, an image width, and thermistor positions when sheets are fed with the use of this control. FIG. 16B illustrates the longitudinal distribution of the target temperature and the film temperature after some sheets have been fed. In addition, FIG. 16C illustrates the longitudinal distribution of the target temperature and the film temperature after the sheet feeding is continuously performed. Also in FIG. 16A, the thermistors that are used for the temperature control are represented as hatched portions.

As illustrated in FIG. 16B, the target temperature after some sheets have been fed is the same as that in FIG. 14B. In the heat generating block HB16, the thermistor T6-C adjacent to the heat generating block HB15 having a high temperature detects a temperature greater than the target temperature due to the propagation of the heat from the heat generating block HB15. Meanwhile, the thermistor T6-E far from the heat generating block HB15 is not affected, and is thus at a temperature that is the same as the target temperature. This means that when the heat generating block HB16 is controlled with the thermistor T6-E far from the image, the amount of heat generation is not changed even when the sheet feeding continues, and the entire region of the heat generating block HB16 can always be maintained at the target temperature or greater as illustrated in FIG. 16C. A similar effect can be obtained in the heat generating block HB12 that is opposite to the heat generating block HB16 with respect to the conveyance reference line X in the longitudinal direction. As described above, when a heat generating block corresponding to the non-image portion is controlled with the thermistor far from an image, it is possible to avoid the problem that arises when the film temperature falls below a predetermined temperature.

Figure 17:
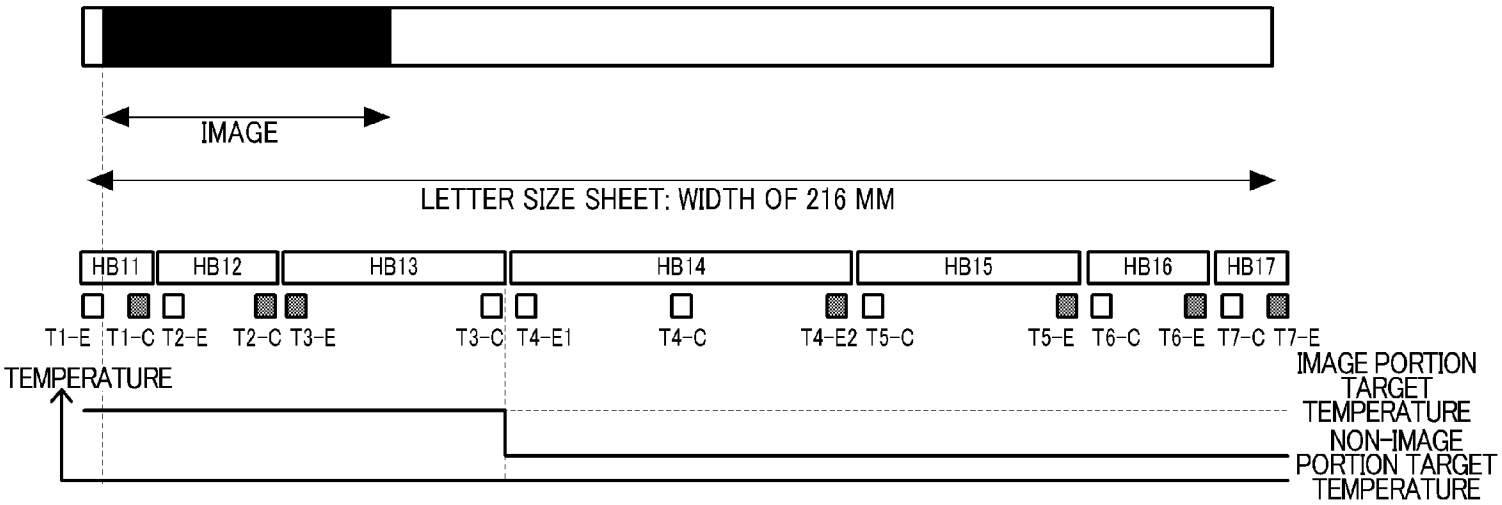
FIG. 17 illustrates another example of the toner image on the feeding sheet in Embodiment 5.

In the present embodiment, the case in which a sheet having formed thereon a symmetrical image is fed is described, but a similar control can be used even when an image is not symmetrical. A similar measure can be used for a case in which an image is only printed on one of the left and right sides of a letter size sheet as in FIG. 17, for example. Also in FIG. 17, the thermistors that are used for the temperature control are represented as hatched portions. In the heat generating block HB12 that is a heat generating block whose entire region corresponds to the image portion, the thermistor T2-C close to the sheet passing reference is used for the control, and in the heat generating blocks HB11 and HB13 that are heat generating blocks partly corresponding to the image portion, the thermistors T1-C and T3-E corresponding to the image portion are used for the control. Further, in the heat generating blocks HB14 to HB17 that are heat generating blocks whose entire regions correspond to the non-image portion, the thermistors T4-E2 and T5-E to T7-E far from the image portion are used. With this, even the film temperature of the entire longitudinal region of the heat generating block HB14 to which the heat propagates from the heat generating block HB13 can be maintained at the target temperature or greater, and all the heat generating blocks can, therefore, be maintained at the target temperature or greater.

In the present embodiment, the thermistor that is used for the temperature control is switched when image information is determined, but the switching timing may not be a timing at which image information is determined. A similar effect can be obtained by the following method, for example: first, the temperature control is performed with the thermistor close to the sheet passing reference, and the control is switched when the thermistor far from the image portion falls below a predetermined temperature.

As described above, when the temperature of a heat generating block corresponding to the non-image portion is controlled with the thermistor far from the image portion, the entire longitudinal region of the heat generating block can be maintained at the film target temperature or greater, and a conveyance failure of recording materials can, therefore, be prevented.

Embodiment 6

In the present embodiment, there is described an example in which the temperature control is switched on the basis of the width and the amount of toner of a toner image to be formed on a recording material. Description of the same matters as those in the above-mentioned embodiments, such as the apparatus configuration, is omitted.

In the fixing apparatus having the heat generating blocks, which are obtained through division in the longitudinal direction, control for achieving energy saving is performed by performing the temperature control depending on the presence or absence of a toner image in the sheet passing region. Specifically, the temperature of a portion of the sheet passing region in which a toner image is present is raised to a temperature necessary for fixing the toner image, and the temperature of a portion of the sheet passing region in which the toner image is not present is lowered to the lower-limit temperature necessary for the film rotation. Further, the region in which the toner image is present has a region in which the amount of toner is small, and, in such a region, the image can be fixed with a low target temperature. Thus, optimal temperature control based on the amount of toner is performed, to thereby achieve energy saving.

In the image forming apparatus of the present embodiment, at the start of printing, toner amount information and position information on an image to be printed on a recording material is obtained, and appropriate temperature control is performed on each of the heat generating elements, which are obtained through division in the longitudinal direction. In this way, electrical power usage is minimized.

Specifically, an image on a feeding sheet is divided per unit area (for example, 10 mm×10 mm), and what percentage of each division does the area of a toner printing region account for is calculated as a coverage rate X. A position in the heat generating block to which the calculated coverage rate corresponds is calculated, and the highest coverage rate in the unit areas in each heat generating block is used as a coverage rate (heat generating block HB-X) that is used for the temperature control of the heat generating block in question. Each heat generating block is controlled on the basis of the value of the heat generating block HB-X with target temperatures in Table 4 below.

TABLE 4

| Coverage Rate X | Film Target Temperature |
|---|---|
| 50% < X ≤ 100% | 170° C. |
| 25% < X ≤ 50% | 160° C. |
| 0% < X ≤ 25% | 150° C. |
| 0% | 120° C. |

Also in such an example, it is necessary that a thermistor that is used for the temperature control be determined so that the film temperature always exceeds a predetermined temperature.

Figure 18:
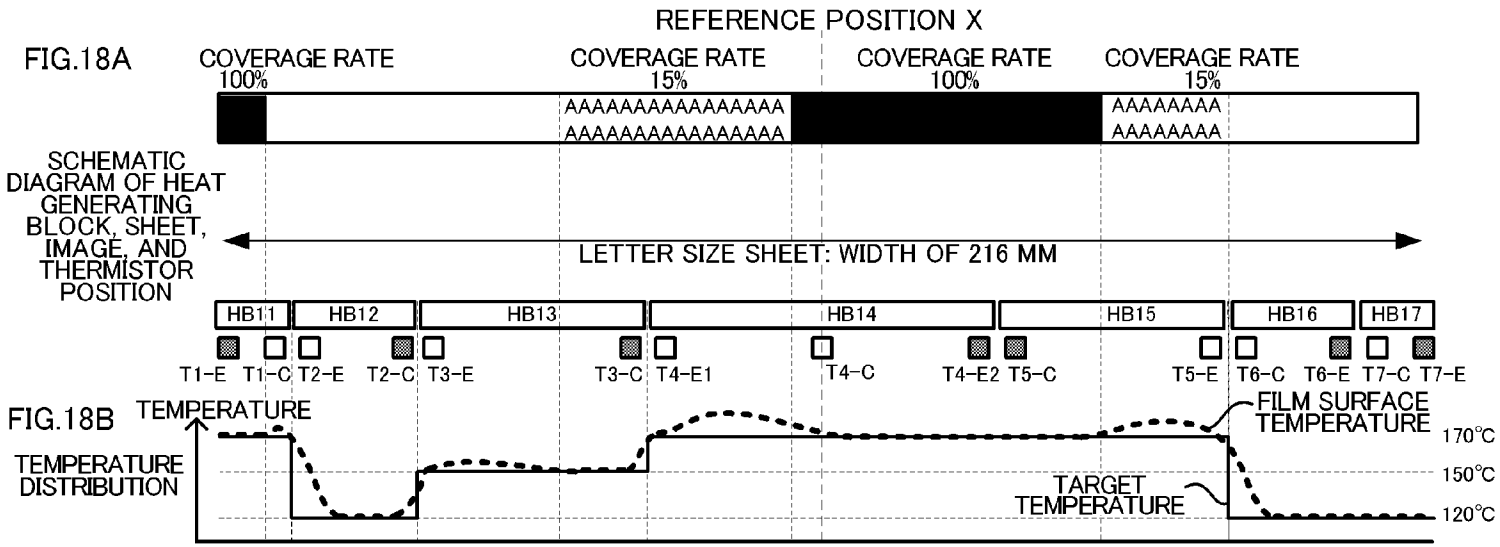
FIGS. 18A and 18B illustrate temperature distribution of Embodiment 6.

As an example, a case in which an image having a coverage rate of 100% and letters having a coverage rate of 15% are mixed on a letter size sheet as in FIG. 18A and FIG. 18B is described. FIG. 18A illustrates a longitudinal positional relationship between a sheet, an image, the heat generating blocks, and thermistor positions. FIG. 18B illustrates the target temperature and the film surface temperature of each heat generating block. In each heat generating block, the thermistors that are used for the temperature control are represented as hatched portions.

The heat generating blocks HB11, HB14, and HB15 are heat generating blocks through which the image having the coverage rate of 100% passes, and hence, are controlled to 170° C., which is a temperature corresponding to the coverage rate of 100%. The heat generating block HB14 is a heat generating block through which the letters having the coverage rate of 15% and the image having the coverage rate of 100% both pass, and is controlled to a temperature for fixing the image that has the coverage rate of 100% and requires a large amount of heat for fixation. The heat generating block HB13 is controlled to 150° C. to fix the letters having the coverage rate of 15%. The heat generating blocks HB12, HB16, and HB17 are heat generating blocks through which no toner image passes, and hence, are set to 120° C., which is close to the lowest temperature necessary for the film rotation.

Next, the thermistors that are used for the temperature control are described. In the heat generating block through which the toner image passes, of the thermistors in the heat generating block, a thermistor corresponding to a region having a high coverage rate is used. This is because toner takes more heat in the region having the high coverage rate to less the film temperature, with the result that the thermistor detects a lower temperature. Through control in the portion at a low film temperature, the temperature of the entire region of the heat generating block can be maintained.

For example, the heat generating block HB11 includes two thermistors of the thermistor T1-E corresponding to the image portion having the coverage rate of 100% and the thermistor T1-C corresponding to the non-image portion having a coverage rate of 0%. Of the thermistors, the thermistor T1-E detects a lower temperature. Thus, the temperature control is performed with the thermistor T1-E so that a predetermined temperature or greater can be maintained. In a similar manner, also in the heat generating blocks HB13 and HB15, the thermistors T3-C and T5-C that correspond to high coverage rate regions are used.

In the heat generating block through which the toner image does not pass, the thermistor far from the image is basically used like Embodiment 5. In the heat generating blocks HB16 and HB17, the thermistors T6-E and T7-E far from the image are used. In a heat generating block through which a toner image does not pass, but which is sandwiched between heat generating blocks through which the toner image passes, such as the heat generating block HB12 in FIG. 18A and FIG. 18B, the target temperatures of the adjacent heat generating blocks are compared to each other, and a thermistor adjacent to the heat generating block at a lower temperature is used. To the heat generating block HB12, the heat of the heat generating block HB11 controlled to 170° C. and the heat of the heat generating block HB13 controlled to 150° C. propagate. As a target temperature difference between the heat generating block HB12 and the adjacent heat generating block becomes greater, the amount of heat that propagates to the heat generating block HB12 becomes greater. Thus, when the temperature control is performed with the thermistor adjacent to the heat generating block having a greater target temperature, the amount of heat generation is reduced and the temperature tends to fall below the target temperature. In view of this, the thermistor adjacent to the heat generating block having a low target temperature is used so that a reduction in amount of heat generation can be prevented. Specifically, in the heat generating block HB12, the thermistor T2-C adjacent to the heat generating block HB13 controlled to 150° C. is used.

Figure 19:
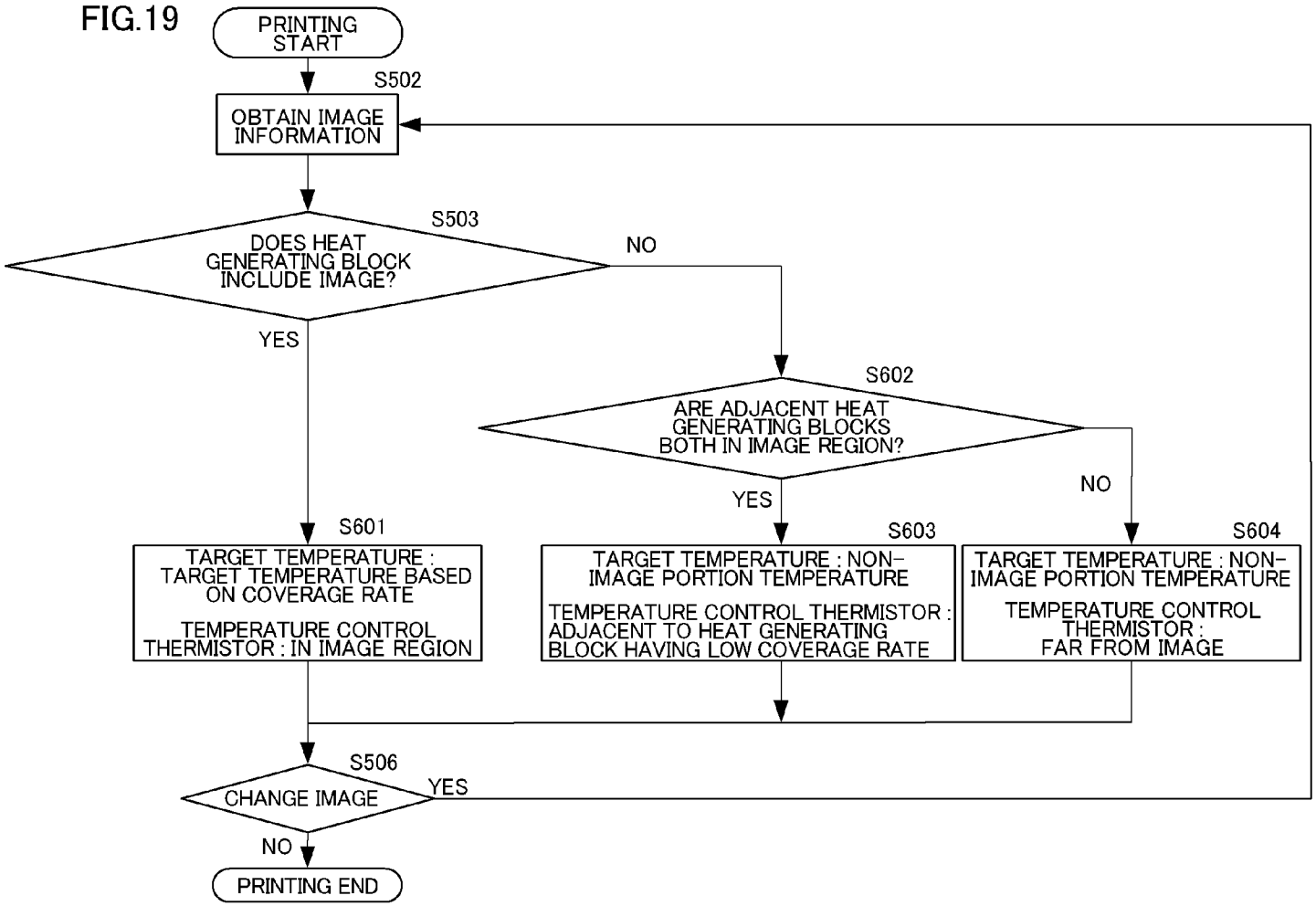
FIG. 19 is a flowchart illustrating Embodiment 6.

The above-mentioned contents are summarized in the flowchart of FIG. 19. Specifically, in the heat generating block including an image, the temperature control is performed with a target temperature based on a coverage rate, with the use of the thermistor placed in a region having a high coverage rate (S601). For the heat generating block including no image, it is determined whether or not two heat generating blocks adjacent to the heat generating block are both heat generating blocks including the image (S602). When both the adjacent heat generating blocks include the image, the temperature control is performed with the target temperature of the non-image portion, with the use of the thermistor at a position close to the heat generating block having a lower coverage rate of the heat generating blocks (S603). When one or both of the adjacent heat generating blocks include no image, the temperature control is performed with the target temperature of the non-image portion, with the use of the thermistor far from the image (S604).

Although no description is given in the example of FIG. 18A and FIG. 18B for a case where no image is present in the thermistor position but the image is present in a part of the heat generating block, in such a case, the temperature control is performed with the thermistor close to the image so that the entire region of the heat generating block can be maintained at the greater target temperature. Further, an image having a greater coverage rate than that at the thermistor position is present in the heat generating block, the temperature control is preferably performed with the thermistor close to a position with a greater coverage rate.

As described above, in the configuration in which the temperature control of each heat generating block is switched on the basis of the image position and the toner amount information, the thermistor that is used for the temperature control is switched so that the target temperature of each heat generating block can be maintained, and a conveyance failure of recording materials can, therefore, be prevented.

The method for maintaining each heat generating block at the target temperature or greater with the use of the position information or the toner amount information on an image is not limited to the above-mentioned method. The method as described in Embodiment 2 may be employed. Specifically, the temperature of the thermistor is monitored, and, when the temperature falls below a predetermined temperature, the measurement is taken.

The configurations of the above-mentioned embodiments can be combined with each other as far as possible.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image heating apparatus, comprising:

an image heating portion that includes a heater including a substrate and a plurality of heat generating elements provided on the substrate and aligned in a longitudinal direction of the substrate, and heats an image formed on a recording material using heat of the heater;

a plurality of temperature detecting elements for detecting temperatures of the plurality of heat generating elements; and an energization controlling portion for selectively controlling, based on the temperature detected by each of the plurality of temperature detecting elements, electric power to be supplied to the plurality of heat generating elements, in order to selectively heat a plurality of heating regions that are heated by the plurality of heat generating elements, wherein at least two temperature detecting elements among the plurality of temperature detecting elements are arranged in each one of the plurality of heating regions being heated by the plurality of heat generating elements, and wherein the energization controlling portion controls electric power supply to the plurality of heat generating elements for the purpose of heating a non-sheet-passing heating region, through which the recording material does not pass, among the plurality of heating regions, based on a temperature detected by a temperature detecting element, which is farthest from a conveyance reference position of the recording material, among the plurality of temperature detecting elements arranged in the non-sheet-passing heating region.

2. The image heating apparatus according to claim 1, wherein the energization controlling portion controls, based on the temperature detected by the temperature detecting element farthest from the conveyance reference position, electric power supply to the plurality of heat generating elements for the purpose of heating the non-sheet-passing heating region, with a target temperature being a temperature lower than a target temperature for heating a sheet-passing heating region, through which the recording material passes, among the plurality of heating regions.

3. The image heating apparatus according to claim 1, wherein the energization controlling portion controls, based on the temperature detected by the temperature detecting element farthest from the conveyance reference position, an amount of electric power to be supplied to the heat generating elements to heat the non-sheet-passing heating region, to an amount of electric power smaller than an amount of electric power that is supplied to the heat generating elements to heat a sheet-passing heating region, through which the recording material passes, among the plurality of heating regions.

4. The image heating apparatus according to claim 1, further comprising a tubular film that rotates with an inner surface thereof being in contact with the heater, wherein the image on the recording material is heated through the tubular film.

5. An image heating apparatus, comprising:

an image heating portion that includes a heater including a substrate and a plurality of heat generating elements provided on the substrate and aligned in a longitudinal direction of the substrate, and heats an image formed on a recording material using heat of the heater;

a plurality of temperature detecting elements for detecting temperatures of the plurality of heat generating elements; and an energization controlling portion for selectively controlling, based on the temperature detected by each of the plurality of temperature detecting elements, electric power to be supplied to the plurality of heat generating elements, in order to selectively heat a plurality of heating regions that are heated by the plurality of heat generating elements, wherein at least two temperature detecting elements among the plurality of temperature detecting elements are arranged in each one of the plurality of heating regions being heated by the plurality of heat generating elements, and wherein the energization controlling portion controls electric power supply to the plurality of heat generating elements for the purpose of heating a non-image heating region, through which the image formed on the recording material does not pass, among the plurality of heating regions, based on a temperature detected by a temperature detecting element, which is farthest from a conveyance reference position of the recording material, among the plurality of temperature detecting elements arranged in the non-image heating region.

6. The image heating apparatus according to claim 5, wherein the energization controlling portion controls, based on the temperature detected by the temperature detecting element farthest from the conveyance reference position, electric power supply to the plurality of heat generating elements for the purpose of heating the non-image heating region, with a target temperature being a temperature lower than a target temperature for heating an image heating region, through which the image formed on the recording material passes, among the plurality of heating regions.

7. The image heating apparatus according to claim 5, wherein the energization controlling portion controls, based on the temperature detected by the temperature detecting element farthest from the conveyance reference position, an amount of electric power to be supplied to the heat generating elements to heat the non-image heating region, to an amount of electric power smaller than an amount of electric power that is supplied to the heat generating elements to heat an image heating region, through which the image formed on the recording material passes, among the plurality of heating regions.

8. An image forming apparatus, comprising:

an image forming portion for forming an image on a recording material; and a fixing portion for fixing, to the recording material, the image formed on the recording material, wherein the fixing portion comprises an image heating portion that includes a heater including a substrate and a plurality of heat generating elements provided on the substrate and aligned in a longitudinal direction of the substrate, and heats the image formed on the recording material using heat of the heater;

a plurality of temperature detecting elements for detecting temperatures of the plurality of heat generating elements; and an energization controlling portion for selectively controlling, based on the temperature detected by each of the plurality of temperature detecting elements, electric power to be supplied to the plurality of heat generating elements, in order to selectively heat a plurality of heating regions that are heated by the plurality of heat generating elements, wherein at least two temperature detecting elements among the plurality of temperature detecting elements are arranged in each one of the plurality of heating regions being heated by the plurality of heat generating elements, and wherein the energization controlling portion controls electric power supply to the plurality of heat generating elements for the purpose of heating a non-sheet-passing heating region, through which the recording material does not pass, among the plurality of heating regions, based on a temperature detected by a temperature detecting element, which is farthest from a conveyance reference position of the recording material, among the plurality of temperature detecting elements arranged in the non-sheet-passing heating region.

* * * * *